US009188951B2

(12) United States Patent
Nojima

(10) Patent No.: US 9,188,951 B2
(45) Date of Patent: Nov. 17, 2015

(54) FIXING APPARATUS

(71) Applicant: CANON KABUSHIKI KAISHA, Tokyo (JP)

(72) Inventor: Koji Nojima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 14/031,507

(22) Filed: Sep. 19, 2013

(65) Prior Publication Data

US 2014/0086617 A1 Mar. 27, 2014

(30) Foreign Application Priority Data

Sep. 24, 2012 (JP) ..... 2012-209397
Aug. 5, 2013 (JP) ..... 2013-162435

(51) Int. Cl.
*G03G 15/20* (2006.01)
*G03G 21/00* (2006.01)
*G03G 21/20* (2006.01)

(52) U.S. Cl.
CPC ..... *G03G 21/20* (2013.01); *G03G 15/2025* (2013.01); *G03G 2215/2035* (2013.01)

(58) Field of Classification Search
USPC ..... 399/98, 122
See application file for complete search history.

(56) References Cited

U.S. PATENT DOCUMENTS

| | | | | |
|---|---|---|---|---|
| 5,525,775 | A | 6/1996 | Setoriyama et al. | |
| 5,678,153 | A * | 10/1997 | Okamoto et al. | 399/327 |
| 7,589,300 | B2 | 9/2009 | Nojima | |
| 8,139,995 | B1 | 3/2012 | Fujita et al. | |
| 2006/0165443 | A1 * | 7/2006 | Yoshinaga et al. | 399/325 |
| 2011/0243598 | A1 * | 10/2011 | Suzuki | 399/98 |
| 2012/0058424 | A1 * | 3/2012 | Kikushima | 430/105 |
| 2014/0086616 | A1 | 3/2014 | Nojima et al. | |
| 2014/0178091 | A1 | 6/2014 | Sugiyama et al. | |

FOREIGN PATENT DOCUMENTS

| | | | |
|---|---|---|---|
| JP | 4-44075 | A | 2/1992 |
| JP | 2010-217580 | A | 9/2010 |
| JP | 2011-112708 | A | 6/2011 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A fixing apparatus includes: first and second rotatable members configured to heat-fix, at a nip therebetween, a toner image of toner containing a parting agent formed on a sheet; a casing, configured to accommodate the first and second rotatable members, including a sheet introducing opening and a sheet discharging opening; and a suppressing member configured to suppress diffusion, toward the sheet discharging opening, of particles having a predetermined diameter resulting from a parting agent in the neighborhood of the sheet introducing opening. The suppressing member is provided in the neighborhood of the sheet introducing opening so as to block diffusion between the casing and the first rotatable member.

20 Claims, 14 Drawing Sheets

(a)

(b)

(a)

(b)

(a)

(b)

(a)

(b)

FIXING APPARATUS

FIELD OF THE INVENTION AND RELATED ART

The present invention relates to a fixing apparatus (device) for fixing a toner image on a sheet. This fixing apparatus is mountable in an image forming apparatus such as a copying machine, a printer, a facsimile machine or a multi-function machine having a plurality of functions of these machines.

In a conventional image forming apparatus of an electrophotographic type, the toner image is formed on the sheet by using a toner in which a parting agent (wax) is incorporated, and then is fixed under heat and pressure in the fixing apparatus.

It has been known that during the fixing, the wax incorporated in the toner is vaporized and immediately thereafter is condensed. According to knowledge of the present inventors, it has been found that in the neighborhood of a sheet introducing opening of the fixing apparatus, the condensed wax (particles of several nm to several hundred nm, hereinafter referred to as also a dust) is present and suspended in a large amount. When no means is taken against such a wax, immediately after the condensation, present in the large amount in the neighborhood of the sheet introducing opening, most of the wax is diffused to outside of the fixing apparatus, so that there is a fear that the image produced by the apparatus is adversely affected. Therefore, it has been required that the wax immediately after condensation is increased in particle diameter so as not to be diffused to the outside of the fixing apparatus.

On the other hand, in a fixing apparatus of an electromagnetic-induction type described in Japanese Laid-Open Patent Application (JP-A) 2010-217580, in order to prevent the wax from being fixed and deposited on a coil holder, a heat generating member is provided in the neighborhood of the coil holder. Specifically, the wax is liquefied by heating the coil holder by the heat-generating member, so that the wax fixed on the coil holder is dropped downward.

Further, in a fixing apparatus described in JP-A 2011-112708, when fine particles deposited on a fixing roller are removed by a cleaning web, a trapping material for trapping the fine particles is contained in the cleaning web.

However, in the fixing apparatuses described in JP-A 2010-217580 and JP-A 2011-112708, the dust present in a large amount in the neighborhood of the sheet introducing opening cannot be suppressed from being diffused as it is to the outside of the fixing apparatuses, and therefore the means therein do not constitute a solution.

SUMMARY OF THE INVENTION

A principal object of the present invention is to provide a fixing apparatus capable of suppressing particles, having a predetermined diameter, resulting from a parting agent from being diffused to an outside of the fixing apparatus as it is.

Another object of the present invention is to provide a fixing apparatus capable of accelerating an increase in particle diameter of the particles, having the predetermined diameter, resulting from the parting agent.

According to an aspect of the present invention, there is provided a fixing apparatus comprising: first and second rotatable members configured to heat-fix, at a nip therebetween, a toner image of toner containing a parting agent formed on a sheet; a casing, configured to accommodate the first and second rotatable members, including a sheet introducing opening and a sheet discharging opening; and a suppressing member configured to suppress diffusion, toward the sheet discharging opening, of particles having a predetermined diameter resulting from a parting agent in the neighborhood of the sheet introducing opening, wherein the suppressing member is provided in the neighborhood of the sheet introducing opening so as to block diffusion between the casing and the first rotatable member.

According to another aspect of the present invention, there is provided a fixing apparatus comprising: first and second rotatable members configured to heat-fix, at a nip therebetween, a toner image of toner containing a parting agent formed on a sheet; a casing, configured to accommodate the first and second rotatable members, including a sheet introducing opening and a sheet discharging opening; and a first suppressing member configured to suppress diffusion, toward the sheet discharging opening, of particles having a predetermined diameter resulting from a parting agent in the neighborhood of the sheet introducing opening, wherein the suppressing member is provided in the neighborhood of the sheet introducing opening so as to block diffusion between the casing and the first rotatable member; and a second suppressing member configured to suppress diffusion, toward the sheet discharging opening, of particles having a predetermined diameter resulting from a parting agent in the neighborhood of the sheet introducing opening, wherein the suppressing member is provided in the neighborhood of the sheet introducing opening so as to block diffusion between the casing and the second rotatable member.

According to another aspect of the present invention, there is provided fixing apparatus comprising: first and second rotatable members configured to heat-fix, at a nip therebetween, a toner image of toner containing a parting agent formed on a sheet; a casing, configured to accommodate the first and second rotatable members, including a sheet introducing opening and a sheet discharging opening; and a sheet-like member configured to be provided in the neighborhood of the sheet introducing opening so as to block diffusion between the casing and the first rotatable member.

According to a further aspect of the present invention, there is provided a fixing apparatus comprising: first and second rotatable members configured to heat-fix, at a nip therebetween, a toner image of toner containing a parting agent formed on a sheet; a casing, configured to accommodate the first and second rotatable members, including a sheet introducing opening and a sheet discharging opening; and a contact member configured to be mounted on an inner surface of, the casing, ranging from the sheet introducing opening to the sheet discharging opening, and configured to contact a surface of the first rotatable member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of a fixing apparatus according to the present invention will be specifically described below. Incidentally, unless otherwise specified, within a scope of concept of the present invention, constitutions of various devices can be replaced with other constitutions.

Embodiment 1

(1) General Structure of Image Forming Apparatus

Before a description of the fixing apparatus, first, a general structure of an image forming apparatus will be described.

Figure 3:
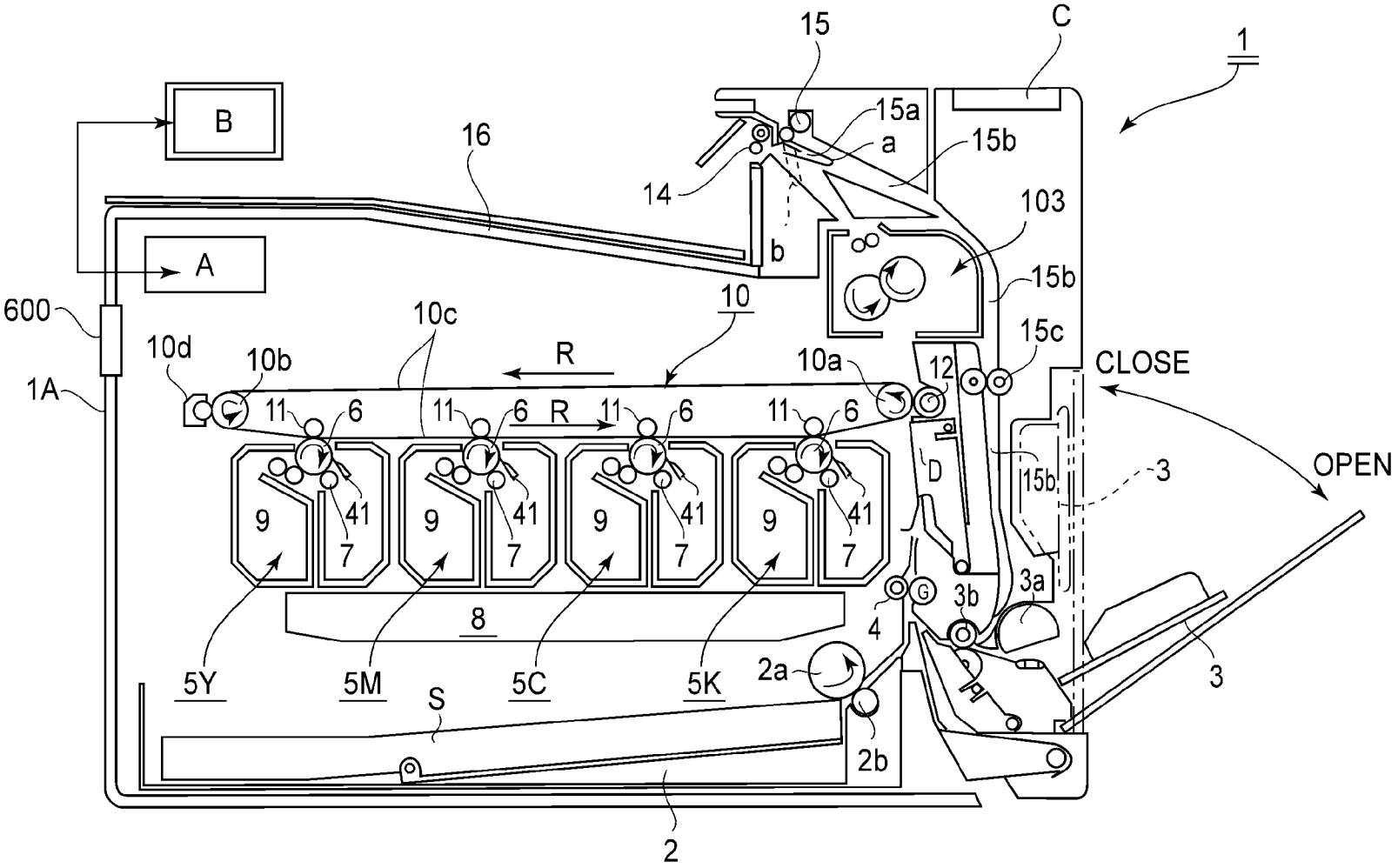
FIG. 3 is a schematic illustration of an image forming apparatus.

FIG. 3 is a schematic sectional view of an image forming apparatus 1. This image forming apparatus 1 is a four color-basis full-color laser beam printer (color image forming apparatus) using an electrophotographic process. That is, the image forming apparatus forms an image on a sheet (recording material such as a sheet, an OHP sheet, coated paper label paper) P on the basis of an electrical image signal inputted from an external host device B, such as a personal computer or an image reader, into a control circuit portion (control means or CPU) A.

The control circuit portion A transfers various pieces of electrical information between itself and the external host device B or an operating portion C, and effects integrated control of an image forming operation of the image forming apparatus 1 in accordance with predetermined control program and reference table.

As an image forming portion 5, the image forming apparatus includes first to fourth (four) image forming stations (process cartridges) 5Y, 5M, 5C and 5K. The first to fourth image forming stations 5Y, 5M, 5C and 5K are successively arranged in parallel from a left side to a right side in FIG. 3 at a substantially central portion of an inside of the image forming apparatus 1.

Each image forming station includes the same electrophotographic process mechanism. Each of the image forming stations 5Y, 5M, 5C and 5K in this embodiment includes a rotation drum-type electrophotographic photosensitive member (hereinafter referred to as a "drum") 6 as an image bearing member on which an image is to be formed. As process means actable on the drum 6, a charging roller 7, a cleaning member 41 and a developing unit 9 are provided.

The first image forming station 5Y accommodates a yellow developer (toner) (Y) in a toner accommodating chamber of the developing unit 9. The second image forming station 5M accommodates a magenta toner (M) in a toner accommodating chamber of the developing unit 9. The third image forming station 5C accommodates a cyan toner (C) in a toner accommodating chamber of the developing unit 9. The fourth image forming station 5K accommodates a black toner (K) in a toner accommodating chamber of the developing unit 9.

In an apparatus main assembly 1A, below the respective image forming stations 5Y, 5M, 5C and 5K, a laser scanner unit 8 as an image information exposure means for the respective drums 6 is provided. Further, in the apparatus main assembly 1A, on the respective image forming stations 5Y, 5M, 5C and 5K, an intermediary transfer belt unit 10 is provided.

The unit 10 includes a driving roller 10*a* provided in a right side in FIG. 3, a tension roller 10*b* provided in a left side in FIG. 3, and an intermediary transfer belt (hereinafter referred to as a belt) 10*c* as an intermediary transfer member extended and stretched between these rollers. Further, inside the belt 10*c*, first to fourth (four) primary transfer rollers 11 opposing the drums 6 of the respective image forming stations 5Y, 5M, 5C and 5K are provided in parallel to each other. An upper surface portion of each of the drums 6 of the image forming stations 5Y, 5M, 5C and 5K contacts a lower surface of the belt 10*c* in a position of the associated primary transfer roller 11. The contact portion is a primary transfer portion.

Outside a curved portion of the belt 10*c* contacting the driving roller 10*a*, a secondary transfer roller 12 is provided. A contact portion between the belt 10*c* and the secondary transfer roller 12 is a secondary transfer portion. Outside a curved portion of the belt 10*c* contacting the tension roller 10*b*, a transfer belt cleaning device 10*d* is provided.

At a lower portion of the apparatus main assembly 1A, a sheet feeding cassette 2 is provided. The cassette 2 is constituted so as to be pullable from and insertable into the apparatus main assembly 1A in a predetermined manner.

In FIG. 3, in a right side in the apparatus main assembly 1, an upward sheet conveying path (vertical path) D is provided for conveying upward the sheet P picked up from the cassette 2. In the sheet conveying path D, in the order from a lower side to an upper side, a roller pair of a conveying roller 2*a* and a retard roller 2*b*, a registration roller pair 4, the secondary transfer roller 12, a fixing apparatus (device) 103, a double-side flapper 15*a*, a discharging roller pair 14 are provided. An upper surface of the apparatus main assembly 1*a* constitutes a discharge tray (discharged sheet stacking portion) 16.

In FIG. 3, in a right surface side of the apparatus main assembly 1A, a manual feeding portion (multi-purpose tray) 3 is provided. The manual feeding portion 3 is capable of being placed in a closed state (retracted state) in which the manual feeding portion 3 is vertically raised and folded with respect to the apparatus main assembly 1A as indicated by a chain double-dashed line during non-use. During use, the manual feeding portion 3 is turned on its side as indicated by a solid line to be placed in an open state.

(1-1) Image Forming Sequence of Image Forming Apparatus

An operation for forming a full-color image is as follows.

A control circuit portion A starts an image forming operation of the image forming apparatus 1 on the basis of a print start signal. That is, in synchronism with image formation timing, each of the drums 6 of the first to fourth image forming stations 5Y, 5M, 5C and 5K is rotationally driven at a predetermined timing in the clockwise direction indicated by an arrow. Also, the belt 10*c* is rotationally driven at a speed corresponding to the speed of the drum 6 in the counterclockwise direction (the same direction as the rotational direction of the drum 6) indicated by an arrow R. Also the laser scanner unit 8 is driven.

In synchronism with this driving operation, at each of the image forming stations 5Y, 5M, 5C and 5K, a surface of the drum 6 is electrically charged uniformly to a predetermined polarity and a predetermined potential by the charging roller 7 to which a predetermined charging bias is applied. The surface of each drum 6 is subjected to scanning exposure, by the laser scanner unit 8, to a laser beam modulated depending on an image information signal of an associated one of colors of Y, M, C and K. As a result, an electrostatic latent image depending on the image information signal of the associated color is formed on the surface of each drum 6. The formed electrostatic latent image is developed as a toner image (developer image) by a developing roller (developing member) of the developing unit 9. To the developing roller, a predetermined developing bias is applied.

By the electrophotographic image forming process operation as described above, a yellow image Y corresponding to a Y component of the full-color image is formed on the drum 6 of the first image forming station 5Y. The toner image is primary-transferred onto the belt 10*c* at the primary transfer portion of the image forming station 5Y. A magenta image M corresponding to an M component of the full-color image is formed on the drum 6 of the second image forming station 5M. The toner image is primary-transferred superposedly onto the yellow toner image Y which has already been transferred on the belt 10*c* at the primary transfer portion of the image forming station 5M. A cyan image C corresponding to a C component of the full-color image is formed on the drum 6 of the third image forming station 5C. The toner image is primary-transferred superposedly onto the yellow and magenta toner images ef-Y and M which have already been transferred on the belt 10*c* at the primary transfer portion of the image forming station 5C. A black image K corresponding to a K component of the full-color image is formed on the drum 6 of the fourth image forming station 5K. The toner image is primary-transferred superposedly onto the yellow, magenta, and cyan toner images Y, M and C which have already been transferred on the belt 10*c* at the primary transfer portion of the image forming station 5K.

To each of the first to fourth primary transfer roller 11, at predetermined control timing, a primary transfer bias of an opposite polarity to a charge polarity of the toner and of a predetermined potential is applied. In this way, unfixed full-color toner images of Y, M, C and K are synthetically formed on the moving belt 10*c*. These unfixed toner images are conveyed by subsequent rotation of the belt 10*c* to reach the secondary transfer portion.

At each of the image forming stations 5, the surface of the drum 6 after the primary transfer of the toner image onto the belt 10*c* is wiped with a cleaning member (cleaning blade) 41 to remove a primary transfer residual toner, thus being subjected to a subsequent image forming step.

On the other hand, the sheets P in the cassette 2 are fed one by one by the feeding roller 2*a* and the retard roller 2*b* at a predetermined control timing, and the fed sheet P is conveyed to the registration roller pair 4. In the case of an operation in a manual feeding mode, the sheet P on the manual feeding tray 3 is fed by a feeding roller 3*a* and then is conveyed to the registration roller pair 4 by a conveying roller pair 3*b*.

The sheet P is conveyed to the secondary transfer portion at predetermined control timing by the registration roller pair 4. To the secondary transfer roller 12, at predetermined control timing, a secondary transfer bias of an opposite polarity to a normal charge polarity of the toner is applied. As a result, in a process in which the sheet P is nipped and conveyed through the secondary transfer portion, the superposed four color toner images on the belt 10*c* are collectively secondary-transferred onto the surface of the sheet P.

The sheet P coming out of the secondary transfer portion is separated from the belt 10*c* to be conveyed into the fixing apparatus 103, and then the toner images are thermally fixed on the sheet P. The sheet P coming out of the fixing apparatus 103 passes through a lower side of the double-side flapper 15*a* held in a first attitude a indicated by a solid line, and then is discharged onto the discharge tray 16 by the discharging roller pair 14. A secondary transfer residual toner remaining on the surface of the belt 10*c* after the secondary transfer of the toner images onto the sheet P is removed from the belt surface by the transfer belt cleaning device 10*d*, and then the cleaned belt surface is subjected to a subsequent image forming step.

The sheet P, coming out of the fixing apparatus 103, which has already been subjected to image formation at its one (first) surface (side) is not discharged onto the discharge tray 16 but can also be subjected to double-side printing by being conveyed into a re-circulating conveying path 15*b* for effecting printing on another (second) surface (side) of the sheet P. In this case, the sheet P, coming out of the fixing apparatus 103, which has already been subjected to image formation at its one surface passes through an upper side of the double-side flapper 15*a* switched to a second attitude b indicated by a broken line, and then is conveyed toward the discharge tray 16 by a switch-back belt 15.

Then, when a downstream end of the sheet P with respect to a conveyance direction reaches a position on the double-side flapper 15*a*, the double-side flapper 15*a* is returned to the first attitude a, and at the same time, the switch-back roller 15 is reversely driven. As a result, the sheet P is reversely conveyed downward in the re-circulating path 15*b* to the registration roller pair 4 again via a conveying roller pair 15*c* and 3*b*. Thereafter, similarly as in the case of an operation in a one-side image forming mode, the sheet P which has already subjected to the double-side printing is conveyed through a path including the secondary transfer portion, the fixing apparatus 103 and the discharging roller pair 14, thus being discharged onto the discharge tray 16.

Incidentally, in this embodiment, as the image forming apparatus 1, the full-color laser beam printer including the plurality of drums 6 is used, but the present invention is also applicable to a fixing apparatus to be mounted into a monochromatic copying machine or printer. Therefore, the image forming apparatus in which the fixing apparatus of the present invention is to be mounted is not limited to the full-color laser beam printer.

Figure 1:
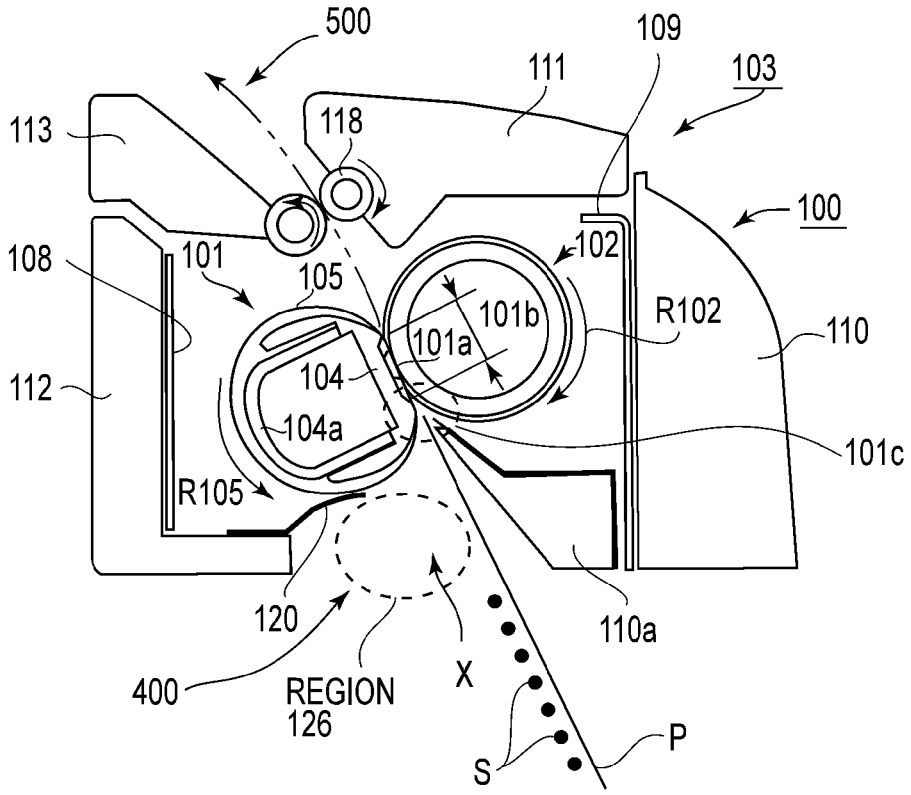
FIGS. 1(*a*) and 1(*b*) are schematic illustration and an exploded perspective view, respectively, of a fixing apparatus.
Figure 1:
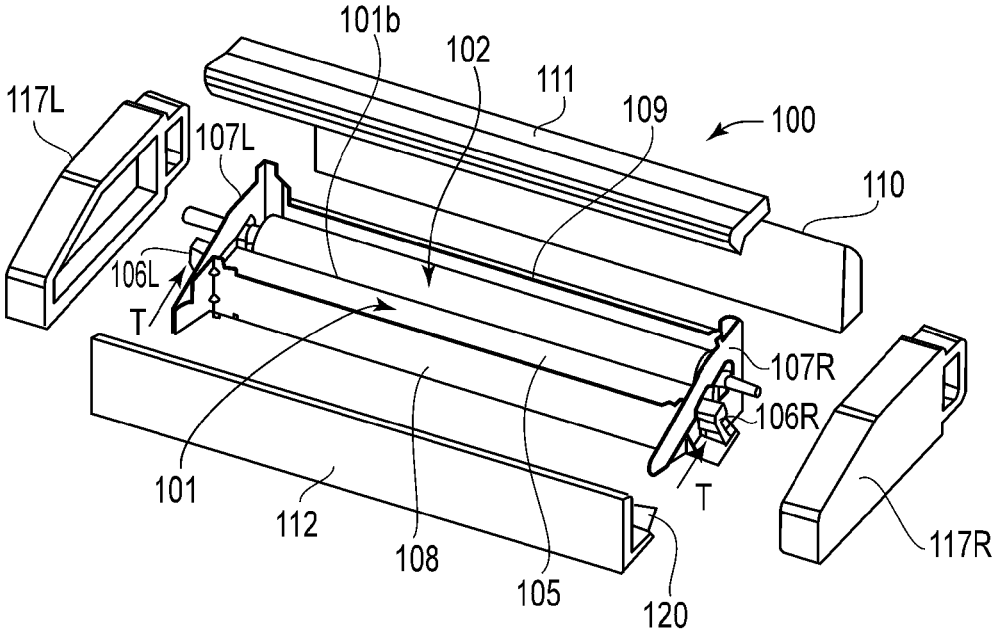

Next, the fixing apparatus 103 will be described. FIG. 1(*a*) is a schematic sectional view of the fixing apparatus 103, and FIG. 1(*b*) is an exploded perspective view of the fixing apparatus 103. The fixing apparatus in this embodiment has a constitution in which a pair of rollers for forming a nip therebetween for heating and pressing the sheet while nip-conveying the sheet during fixing is provided. Specifically, a fixing apparatus of a belt (film) fixing type using a planar (thin plate-like) heater 101*a*, such as a ceramic heater as a heating source, is used. A heating apparatus of this type has been known by, e.g., JP-A Hei 4-44075.

The fixing apparatus 103 is an elongated apparatus such that a direction parallel to a direction perpendicular to a conveyance direction (X) of the sheet P in a plane of a sheet conveying path at the nip is a longitudinal direction (widthwise direction). The fixing apparatus 103 roughly includes the fixing unit provided with the heating unit 101 and the pressing roller (pressing member) 102 and includes a casing 100 accommodating these members.

(2-1) Structure of Casing

In the casing 100, as shown in FIG. 1(*a*), an introducing opening (sheet introducing opening) 400 is formed in a position where the sheet is to be introduced, and a discharge opening (sheet discharge opening) 500 is formed in a position where the sheet is to be discharged. Further, the fixing belt 105 and the pressing roller 102 are disposed so that the introducing opening 400 is located below the discharge opening 500 with respect to the direction of gravitation, and the apparatus in this embodiment has a constitution, which is so-called a vertical path type apparatus, in which the sheet is conveyed from below to above with respect to the direction of gravitation.

(2-2) Structure of Heating Unit

Figure 2:
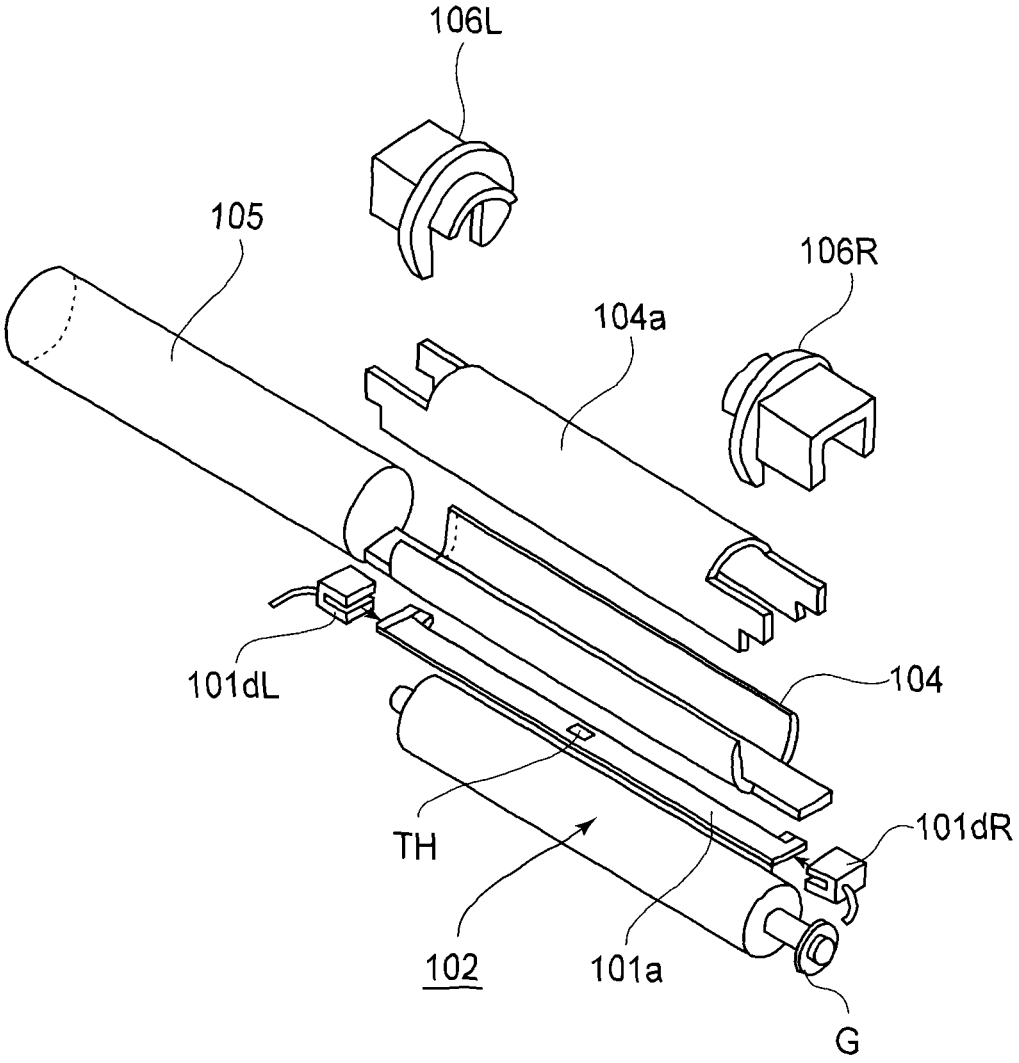
FIG. 2 is an exploded perspective view of a heating unit.

FIG. 2 is an exploded perspective view of the heating unit 101. Incidentally, also the pressing roller 102 is illustrated.

The heating unit 101 is an assembled member including a heater holder 104, a planar heater 101*a*, an urging (pressing) stay 104*a*, the fixing belt 105 as a rotatable heating member to be rotated, flanges 106L and 106R located in end sides of the fixing belt 105 with respect to the widthwise direction of the fixing belt 105, and the like.

The heater holder 104 is an elongated member having an almost semi-circular trough shape in cross section, and is formed of a heat-resistant resin material such as a liquid crystal polymer. The heater 101*a* is an elongated planar heat-generating member, having low thermal capacity, a ceramic heater abruptly increased in temperature by electrical energy supply, and is provided and held along the heater holder 104. The urging stay 104*a* is an elongated rigid member having a U-shape in cross section, and is formed of metal, such as iron, and is provided inside the heater holder 104. The fixing belt 105 is loosely engaged (fitted) externally with the assembled member of the heater holder 104, the heater 101*a* and the urging stay 104*a*.

The flanges 106L and 106R are symmetrical molded members formed of a heat-resistant resin material, and are mounted symmetrically in longitudinal end sides of the heater holder 104*a*. The flanges 106L and 106R correspond to arcuate holding members for holding the fixing belt 105 and for guiding rotation of the fixing belt 105. Movement of widthwise end portions of the fixing belt 105 in a widthwise direction is limited by the flanges 106L and 106R.

Each of the flanges 106L and 106R includes, as shown in FIG. 2, a flange portion, a shelf portion and a portion-to-be-urged. The flange portion is a member for limiting movement of the fixing belt 105 in a thrust direction by receiving an end surface of the fixing belt 105, and has an outer configuration larger than an outer configuration of the fixing belt 105. The shelf portion is provided in an arcuate shape in an inner surface side of the flange portion and holds the fixing belt end portion inner surface to keep the cylindrical shape of the fixing belt 105. The portion-to-be-urged is provided in an outer surface side of the flange portion and receives an urging force by an urging means (not shown).

Figure 4:
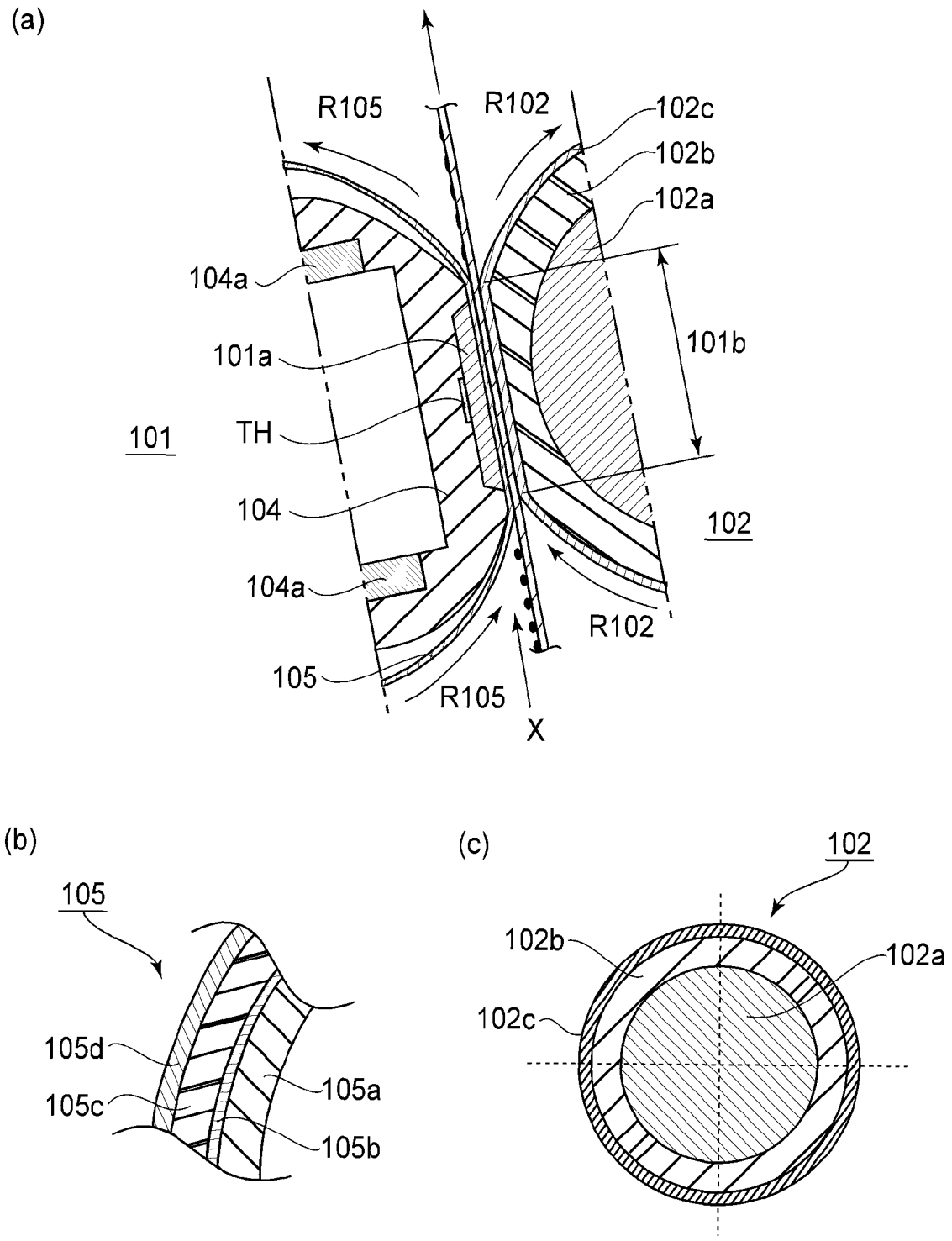
FIG. 4(*a*) is an enlarged view of a fixing nip, FIG. 4(*b*) is a schematic view showing a layer structure of a fixing belt, and FIG. 4(*c*) is a schematic view showing a layer structure of a pressing roller.

FIGS. 4(*a*) and 4(*b*) are schematic views showing a layer structure of the fixing belt 105 in this embodiment. FIG. 4(*a*) is an enlarged view of a nip 101*b*. The fixing belt 105 is a composite layer member in which an endless (cylindrical) base layer 105*a*, a primer layer 105*b*, an elastic layer 105*c* and a parting layer 105*d* are laminated. The fixing belt 105 is a thin and low thermal capacity member having flexibility as a whole.

The base layer 105*a* is formed of metal such as SUS (stainless steel) and has a thickness of about 30 μm for withstanding thermal stress and mechanical stress. The primer layer 105*b* is formed on the base layer 105*a* by applying a primer in a thickness of about 5 mm.

The elastic layer 105*c* deforms when the toner image is press-contacted to the fixing belt 105, and performs the function of causing the parting layer 105*d* to hermetically contact the toner image. The parting layer 105*d* uses PFA resin material having excellent parting and heat-resistant properties in order to ensure a performance for preventing deposition of the toner and paper dust. The thickness of the parting layer 105*d* is about 20 μm from a viewpoint of ensuring a heat conduction property.

FIG. 4(*c*) is a schematic view showing a layer structure of the pressing roller 102.

The pressing roller 102 is an elastic roller including a metal core 102*a* of aluminum or iron, an elastic layer 102*b* formed of a silicone rubber or the like, and a parting layer 102*c* for coating the elastic layer 102*b*. The parting layer 102*c* is formed of a fluorine-containing resin material such as PFA and is a tube coating.

The casing 100 includes, as shown in FIGS. 1(*a*) and 1(*b*), an elongated inner metal plate frame constituted by a base plate 109, a stay 108, a side plate 107L and another side plate 107R. Further, the casing 100 includes an elongated outer frame, of a heat-resistant resin material, constituted by a cover 110, a first upper cover 111, a front cover 112, a second upper cover 113, a side cover 117L and another side cover 117R. Incidentally, in FIG. 1(*b*), in order to prevent this figure from being complicated, a part of components, such as the second upper cover 113, is omitted from illustration.

The pressing roller 102 is provided and rotatably supported between the side plate 107L and another side plate 107R of the inner frame via a bearing as a holding member in each of end sides of the metal core 102*a*.

The heating unit 101 is disposed, in parallel to the pressing roller 102, between the side plate 107L and another side plate 107R of the inner frame while opposing the pressing roller 102 in the heater 101*a* side.

Here, the flanges 106L and 106R in the end sides of the heating unit 101 are slidably engaged with guide holes (not shown), directed toward the pressing roller 102, formed in the side plates 107L and 107R in the end sides of the inner frame. Then, each of the flanges 106L and 106R in the end sides is urged at a predetermined urging force T (FIG. 1(*b*) in a direction toward the pressing roller 102 by an urging means (not shown).

As a result, the fixing belt 105 is rotated by rotation of the pressing roller 102. That is, in this embodiment, the pressing roller 102 performs also the function of a driving roller (rotatable driving member) for rotationally driving the fixing belt 105.

By the above-described urging force, the entirety of the flanges 106L and 106R, the urging stay 104*a* and the heater holder 104 is moved in the direction toward the pressing roller 102. For that reason, the heater 101*a* is urged toward the pressing roller 102 via the fixing belt 105 at the predetermined urging force T, so that the nip 101*b* (FIG. 1(*a*) and FIG. 4(*a*)) having a predetermined width is formed between the fixing belt 105 and the pressing roller 102 with respect to the sheet conveyance direction (X).

(2-4) Fixing Sequence

An operation of a fixing sequence (fixing process) of the fixing apparatus 103 is as follows.

The control circuit portion A rotationally drives the predetermined roller 102 at point control timing in a rotational direction R102 in FIG. 1(*a*) at a predetermined speed. The rotational driving of the pressing roller 102 is performed by transmitting a driving force of a driving source (not shown) to a driving gear G (FIG. 2) integral with the pressing roller 102.

By the rotational driving of the pressing roller 102, at the nip 101*b*, a rotational torque acts on the fixing belt 105 due to a frictional force between the fixing belt 105 and the pressing roller 102. As a result, the fixing belt 105 is rotated around the heater holder 104 and the urging stay 104*a* by the pressing roller 102 at a speed substantially corresponding to a speed of the pressing roller 102 while sliding at its inner surface on the heater 101*a* in close contact with the heater 101*a*.

Further, the control circuit portion A starts electrical energy (power) supply from a power source portion (not shown) to the heater 101*a*. The electrical energy supply to the heater 101*a* is made via electrical energy supplying connectors 101*d*L and 101*d*R (FIG. 2) mounted on the heater 101*a* in end sides of the heater 101*a*. By this electrical energy supply, the heater 101*a* is quickly increased in temperature over an effective full length region. This temperature rise is detected by a thermistor TH as a temperature detecting means provided in a rear side (opposite from the nip 101*b*) of the heater 101*a*.

The control circuit portion A controls, on the basis of the heater temperature detected by the thermistor TH, electrical power to be supplied to the heater 101*a* so that the heater temperature is increased up to and kept at a predetermined target set temperature. The target set temperature in this embodiment is about 170° C.

In a fixing apparatus state described above, the sheet P on which unfixed toner images S are carried is conveyed from the secondary transfer portion side of the image forming portion to the fixing apparatus 103 side, and then is introduced into a nip entrance 101*c* (FIG. 1(*a*)) while being guided by a guide member 110*a* (FIG. 1(*a*)), so that the sheet P is nipped and conveyed through the nip 101*b*. To the sheet P, in a process in which the sheet P is nipped and conveyed through the nip 101*b*, heat of the heater 101*a* is applied via the fixing belt 105. The unfixed toner images S are melted by the heat of the heater 101*a* and are fixed on the sheet P by pressure applied to the nip 101*b*. The sheet P coming out of the nip 101*b* is sent to an outside of the fixing apparatus 103 by a fixing discharge roller pair 118 (FIG. 1(*a*)).

(3) Parting Agent Incorporated in Toner

Next, a parting agent incorporated (contained) in the toner S, i.e., a wax in this embodiment will be described.

There is a fear that a phenomenon which is called offset such that the toner S is transferred onto the fixing belt 105 during fixing is caused, and such an offset phenomenon leads to a factor which causes a problem such as an image defect.

Therefore, in this embodiment, the wax is incorporated into the toner S. That is, during the fixing, the wax bleeds from the toner S. As a result, the wax melted by heating is present at an interface between the fixing belt 105 and the toner image on the sheet P, so that it becomes possible to prevent the offset phenomenon (parting action).

Incidentally, also a compound containing a molecular structure of the wax is referred herein to as the wax. For example, such a wax is obtained by reacting a resin molecule of the toner with a wax molecular structure. Further, as a parting agent, other than the wax, it is also possible to use another substance, such as a silicone oil, having a parting action.

In this embodiment, paraffin wax is used and a melting point Tm of the wax is about 75° C. In the case where the heater temperature at the nip 101*b* is kept at the target set temperature of 170° C., the melting point Tm is set so that the wax in the toner S is instantaneously melted to bleed out to an interface between the toner image and the fixing belt 105.

When the wax is melted, a part of the wax such as a low-molecular-weight component of the wax is vaporized (volatilized). Although the wax is constituted by a long-chain molecular component, the length of the component is not uniform and has a certain distribution. That is, it would be considered that the wax contains a low-molecular-weight component having a short chain and a low boiling point and a high-molecular-weight component having a long chain and a high boiling point and that the low-molecular-weight component as a part of the wax is vaporized.

The vaporized wax component is condensed by being cooled in the air, so that fine particles (dust) of several nm to several hundred nm in particle diameter can be present immediately after the condensation. However, it is assumed that most of the condensed wax component forms the fine particles of several nm to several ten nm in particle diameter. This dust is a wax component and therefore has an adhesive property, so that there is a fear that the dust is deposited in positions inside the image forming apparatus 1 to cause a problem. For example, when the dust is fixed and deposited on the fixing discharge roller pair 118 and the discharge roller pair 114 to generate contamination, there is a fear that the contamination is transferred onto the sheet P to adversely affect the image. Further, there is a fear that the dust is deposited on a filter 600 (FIG. 3) provided in an exhausting (heat exhausting) mechanism for exhausting ambient air at a periphery of the fixing apparatus 103 mounted in the image forming apparatus 1, thus causing clogging.

(4) Generated Particles (Dust) Resulting from Parting Agent with Fixing

According to study by the present inventors, it was found that most of the wax (parting agent) component (also referred to as the dust) which is vaporized (volatilized) during the fixing and which is then condensed is present in the neighborhood of the sheet introducing opening 400 (nip entrance 101*c*) of the fixing apparatus 103. Further, it was found that a phenomenon that in the neighborhood of the sheet introducing opening 400 (nip entrance 101*c*) of the fixing apparatus 103, the wax components (dusts) were increased in particle size by their mutual collision was accelerated. This will be described in detail below.

(4-1) Property and Generation Position of Dust

Figure 5:
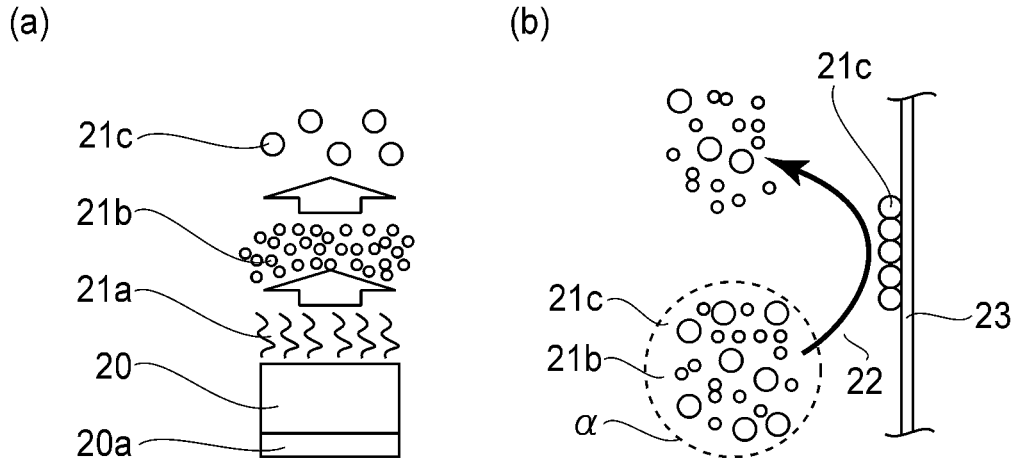
FIG. 5(*a*) is a schematic view for illustrating a coalescence phenomenon of a dust, and FIG. 5(*b*) is a schematic view for illustrating a deposition phenomenon of the dust.

As a property of the dust resulting from the parting agent (wax), a property that the dust components coalesce with each other to be increased in diameter and a property that the dust is deposited on a solid matter in the air have been known. FIGS. 5(*a*) and 5(*b*) are schematic views for illustrating these properties. As shown in FIG. 5(*a*), when a high-boiling-point substance 20 of 150-200° C. in a boiling state is placed on a heating source 20*a* and is heated to about 200° C., volatile matter 21*a* of the high-boiling-point substance 20 is generated. The volatile matter 21*a* is decreased in temperature to a boiling point temperature or less immediately after the volatile matter 21*a* contacts the air at a normal temperature, and therefore the volatile matter 21*a* is condensed in the air, thus being changed into fine particles (dust) 21*b* of several nm to several ten nm in particle size. This phenomenon is the same as a phenomenon that water vapor is changed into minute water droplets to generate fog when the temperature of the water vapor is below a dew-point temperature.

Further, it has been known that the particles of dust 21*b* move in the air by Brownian movement and therefore mutually collide and coalesce to grow into the particles of the dust 21*c* having a larger particle size. This growth is accelerated when the dust more actively moves, in other words, when ambient temperature increases. Further, the growth gradually slows down and stops when the dust has a certain particle size or more. This is presumably because when the dust is increased in particle size by the coalescence, the movement of the dust in the air by Brownian movement becomes inactive.

Next with reference to FIG. 5(*b*), the case where the air a containing the minute dust 21*b* and the larger dust 21*c* moves toward a wall 23 along airflow 22 will be considered. At this time, the larger dust 21*c* than the minute dust 21*b* is liable to be deposited on the wall 23 and is less liable to be diffused. This is presumably because the dust 21*c* has a large force of inertia and vigorously collides against the wall 23. This phenomenon is similarly generated even in the case where the airflow speed is not more than 0.2 m/s, which is below a measurement limit of an anemometer, i.e., even in the case where the airflow speed is very slow. Therefore, it is understood that when the dust 21*c* is increased in particle size more and more, particularly, the fine particles of about several hundred nm are readily left in the fixing apparatus (most of the fine particles is deposited on the belt) and thus diffusion toward the outside of the fixing apparatus can be suppressed.

In this way, the dust has two properties including a property such that the dust is increased in particle size by the coalescence and a property such that the dust is liable to be deposited on a peripheral object (member) when the dust is increased in particle size. Incidentally, eased of the coalescence of the dust depends on components, temperature and density of the dust. For example, when an easily adhesive component is softened at high temperatures or when the collision probability between dust particles is increased at a high density, the dust particles are liable to coalesce. Accordingly, it is understood that when the dust is increased in particle size, it is possible to suppress the diffusion of the dust toward the outside of the fixing apparatus in a state of the fine particles (particle size immediately after the condensation).

Figure 6:
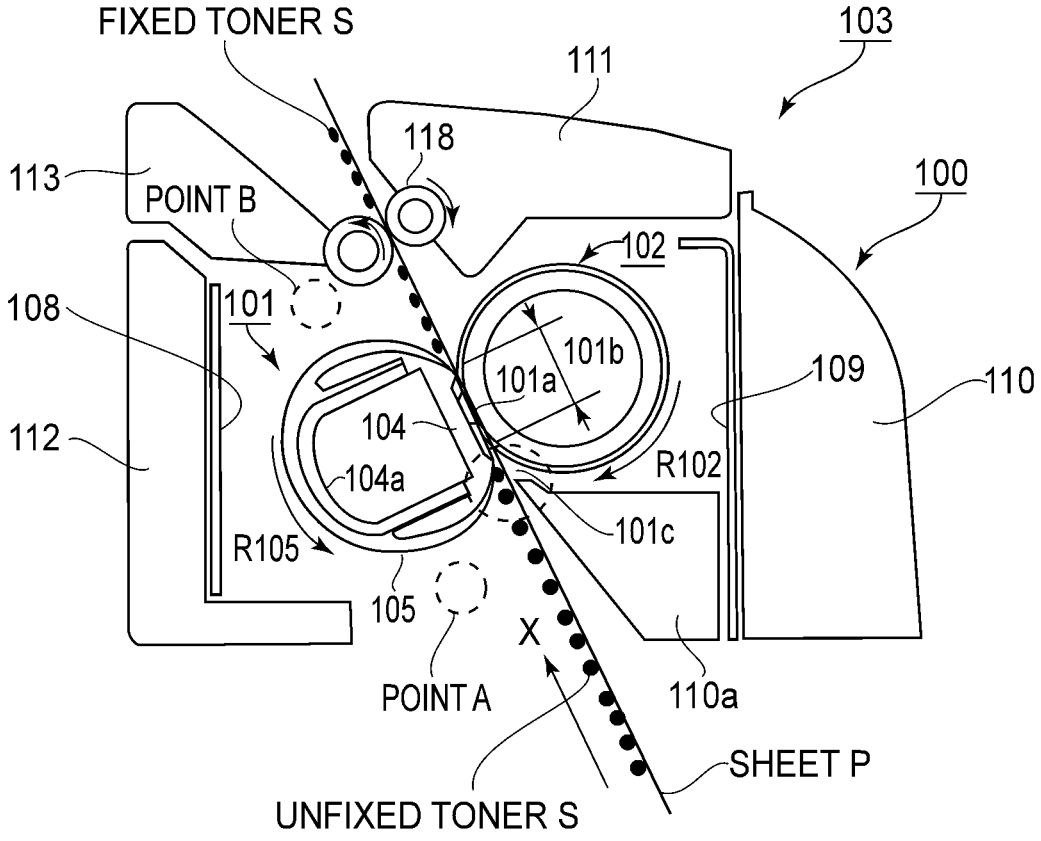
FIG. 6 is a schematic sectional view, of the fixing apparatus, for illustrating a generation point of the dust.
Figure 7:
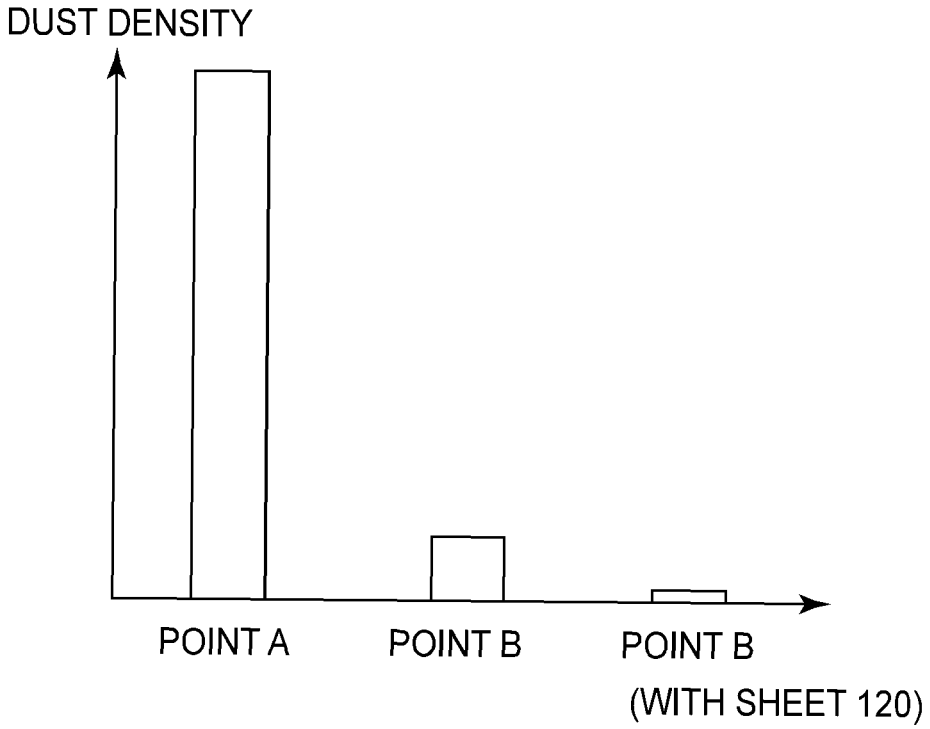
FIG. 7 is a graph showing a dust density at a periphery of the fixing belt.

Next, generation positions (points) of the dust will be described on the basis of FIGS. 6 and 7. FIG. 6 is different from FIG. 1(*a*) and shows a state in which the sheet P on which the toner images are carried is nipped and conveyed at the nip 101*b* and thus the dust is generated. In such a state (situation), when a dust density is measured at an entrance-side point A and an exit-side point B of the nip 101*b*, as shown in FIG. 7, the dust density at the point A was remarkably high. For measurement of the dust density, a high-speed response type particle size ("FMPS", mfd. by TSI Inc.) was used. The high-speed response type particle sizer (FMPS) is capable of measuring a number density (concentration) (particles/$cm^3$) and a weight density (concentration) (μg/$m^3$). In this embodiment, as described later, the number density (particles/$cm^3$) of the fine particles of 5.6 nm or more and 560 nm or less in particle size (particles of a predetermined particle size) is used as the dust density.

The result (FIG. 8) shows that a dust generation position (point) is in the neighborhood of the introducing opening 400 (nip entrance 101*c*). As a predicted reason for this phenomenon, it would be considered that when the high-temperature fixing belt 105 contacts the toner images, the low-molecular-weight component of the wax is instantaneously volatilized and the volatilization is ended at about the time the component passes through the nip 101*b*.

(4-2) Dust Diffusion Path

A path along which the dust generated in the neighborhood of the introducing opening 400 (nip entrance 101*c*) is gradually diffused into the fixing apparatus will be described on the basis of a verification result of a hot airflow simulation shown in FIG. 8.

In this verification with respect to the heat and the airflow, it is assumed that the fixing belt 105 at a surface temperature of 170° C. is rotated in the counterclockwise direction R105 at a speed V, the pressing roller 102 is rotated in the clockwise direction R102 at the speed V, and the sheet P is moved upward in the figure at the speed V. For that reason, in this verification, ascending airflows (CD1 and CD2) due to natural convection generated at a periphery of the fixing belt 105 and the pressing roller 102, an airflow (RD1) at the belt surface generated with surface movement of the fixing belt 105 and the pressing roller 102, and an BB airflow (RD2) at the roller surface generated with surface movement of the pressing roller 102 are taken into consideration.

Figure 8:
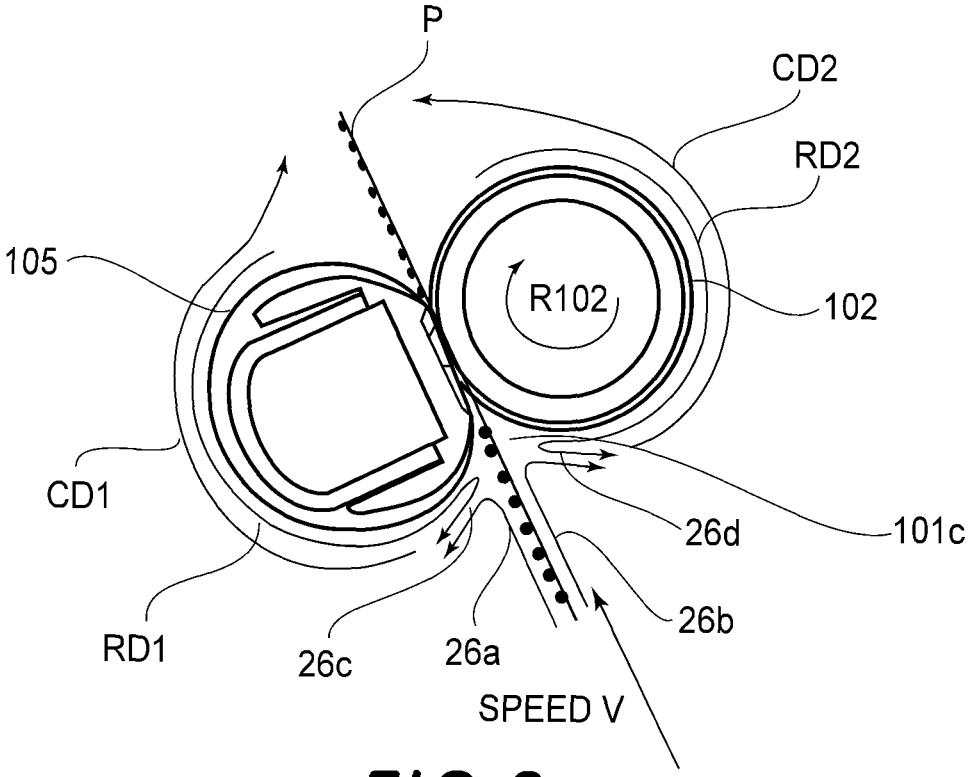
FIG. 8 is a schematic view showing airflow in a casing of the fixing apparatus.

As shown in FIG. 8, it was confirmed that airflows 26*c* and 26*d*, which appear to lose a place to go at the nip 101*b* and to be issued from the nip 101*b* are present.

It would be considered that the airflow 26*c* is the issued air which loses the place to go as a result of collision at the nip entrance 101*c* between the airflow RD1 and the airflow 26*a*, which is generated at the sheet surface with movement of the sheet surface. Further, similarly, it would be considered that the airflow 26*d* is the issued air which loses the place to go as a result of collision at the nip entrance 101*c* between the airflow RD2 and the airflow 26*b* which is generated at the sheet surface with movement of the sheet surface.

Further, the airflow 26*c* merges with the airflow RD1 to form the airflow CD1 which is adjacent to the airflow RD1 and which flows in an opposite direction to the direction of the airflow RD1, i.e., the airflow which moves upward along the surface of the fixing belt 105. Similarly, the airflow 26*d* merges with the airflow RD2 to form the airflow CD2 which is adjacent to the airflow RD2 and which flows in an opposite direction to the direction of the airflow RD2, i.e., the airflow which moves upward along the surface of the pressing roller 102.

Incidentally, the airflows 26*c* and 26*d* were, as shown in FIG. 8, generated so as to move along the surfaces of the fixing belt 105 and the pressing roller 102, respectively, but this is presumed to be a result that these airflows are drawn by the natural convection moving upward in the neighborhood of the surfaces of the fixing belt 105 and the pressing roller 102.

Figure 9:
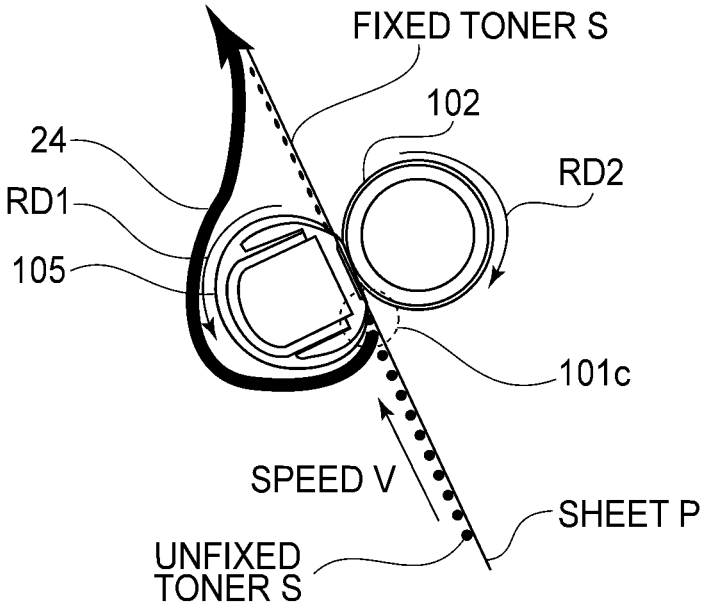
FIGS. 9(*a*) and 9(*b*) are schematic views each showing airflow in the casing of the fixing apparatus.
Figure 9:
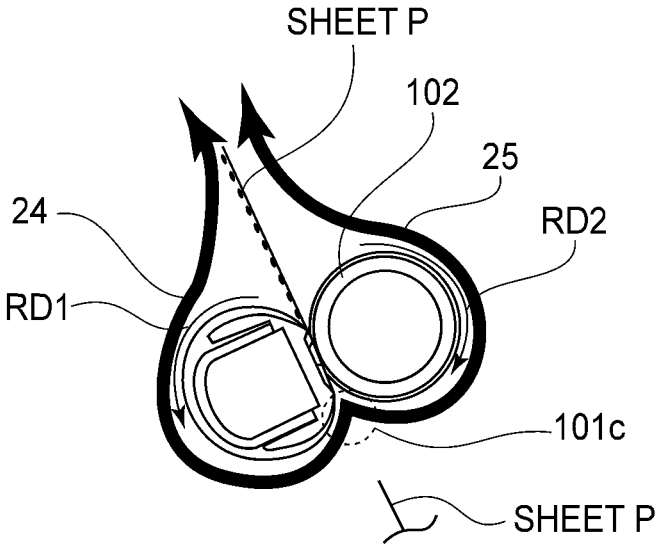

FIG. 9(*a*) shows a state in which the particles (dust) generated in the neighborhood of the introducing opening 400 (nip entrance 101*c*) in the fixing belt 105 side of the sheet P gradually flow along a path 24 by the airflows 26*c* and RD1 shown in FIG. 8. This path 24 represents a path along which phantom particles of zero in weight gradually flow when the phantom particles are generated at the nip entrance 101*c*. This method is used for studying an airflow path on the basis of the airflow simulation result.

According to the path 24 in FIG. 9(*a*), the phantom particles (corresponding to the dust) generated in the neighborhood of the introducing opening 400 (nip entrance 101*c*) move in the clockwise direction along the surface of the fixing belt 105 and passes through a gap in the neighborhood of the fixing discharge roller pair 118 (FIG. 1(*a*)), and then moves upward along the sheet P. That is, it was found that the dust generated at the nip entrance 101*c* passes through the gap belt the fixing belt 105 and the casing 100 and moves upward, and then is gradually diffused to the outside of the fixing apparatus. Further, as shown in FIG. 9(*b*), the sheet P entering the nip entrance 101*c* keeps a predetermined sheet interval D during continuous sheet passing. That is, there is a time when there is no sheet in the neighborhood of the nip entrance 101*c* and therefore at that time, the dust generated in the image surface side of the sheet P passes through the sheet interval D to get out of the sheet P toward the pressing roller 102. The dust gets out of the sheet P carried by the airflows 26*d* and CD2 in FIG. 8 and then is gradually diffused into the inside of the fixing apparatus along a path 25 shown in FIG. 9(*b*). The presence of the airflow along the path 25 was confirmed by the airflow simulation similarly as in the case of the path 24. Further, the fact that the dust is carried along the path 25 was confirmed by measuring the dust density in the neighborhood of the path 25 by using the high-speed response type particle sizer (FMPS).

In the above, the coalescence and deposition of the dust, the fact that most of the dust generation positions are in the neighborhood of the introducing opening 400 (nip entrance 101*c*), and the fact that the generated dust gradually moves along the surfaces of the fixing belt 105 and the pressing roller 102 were described.

When a diffusion suppressing measure against the dust inside the image forming apparatus 1 is studied, it is understood that the air containing the dust may preferably be left in the neighborhood of the fixing belt 105 and the pressing roller 102, i.e., in the neighborhood of the introducing opening 400 (nip entrance 101*c*). This is because as described above, this region is close to the dust generation positions and therefore the dust density is high and is also because the ambient temperature is high by surface heat of the fixing belt 105, and therefore the region is suitable for the acceleration of the dust coalescence.

Specifically, when the flow of the dust is blocked, the dust cannot move the inside of the casing 100, so that the dust remains in a region 126 shown in FIG. 1(*a*). The dust stagnated in these regions is high in temperature and density, and therefore the coalescence of the dust is quickly and efficiently advanced. Then, the dust increased in particle size by the coalescence is moved toward the fixing belt 105 and the pressing roller 102 by being carried by the upward airflow generated by the natural convection and the movement of the sheet P. The dust increased in particle size is capable of being deposited, but its amount is very small and therefore the influence on the image falls within a level where it is practically negligible.

Therefore, the fixing apparatus 103 in this embodiment is provided, in its casing 103, with a diffusion suppressing mechanism (120). By providing such diffusion suppressing mechanisms, the dust density is made to be about ⅕ of the dust density measured in the case of a constitution in which the diffusion suppressing mechanisms are not provided. This is because, in this way, movement of the airflows CD1 and CD2 (FIG. 8) can be suppressed, and therefore it becomes possible to make a problem due to the dust at a level of practically negligible.

The dust density can be measured by the above-described high-speed response type particle sizer (FMPS). Specifically, as shown in FIG. 1(*a*), the dust density was measured at a point (position of 40 mm from the exit of the nip 101*b* in terms of a distance in a straight line) located in the neighborhood of the discharge opening (sheet discharge opening) 500 of the casing 100 which is an exit of the path 24 (FIGS. 9(*a*) and 9(*b*)) along which the dust is capable of being diffused. Further, the measurement is made under the following condition. Specifically, under a condition such that A4-sized plain paper is fed by long edge feeding on the basis of a standard original of 5% print ratio, and fixing is continuously effected for 11 minutes. Further, for 1 minute (from after 10 minutes to 11 minutes), the dust density is measured. A measured value was obtained by averaging the dust densities in 1 minute.

Incidentally, the measurement may also be made at a point (position of 40 mm from the exit of the nip 101*b* in terms of a distance in a straight line) located in the neighborhood of the discharge opening (sheet discharge opening) 500 of the casing 100 which is an exit of the path 25 (FIG. 9(*b*)) along which the dust is capable of being diffused.

Further, in this embodiment, the dust density refers to the number density (particles/$cm^3$) of the fine particles having the particle size (diameter) in a predetermined range, i.e., the fine particles of 5.6 nm or more and 560 nm or less in particle size. That is, the number density measured at the point C1 (C2) may desirably be made not more than ⅕ of the number density in the constitution in which the diffusion suppressing mechanism as employed in this embodiment is not provided. Incidentally, as the dust density, in place of the number density (particles/$cm^3$), the weight density (μg/$m^3$) may also be employed.

Specifically, the diffusion suppressing mechanism is provided in the heating unit 101 side and will be described specifically below.

(5-1) Structure of Diffusion Suppressing Mechanism

As shown in FIG. 1(*a*), the diffusion suppressing mechanism includes a diffusion suppressing member 120, functioning as a suppressing portion, in the neighborhood of the introducing opening (sheet introducing opening) 400 of the casing 100.

Specifically, the diffusion suppressing member (contact member) 120 is a flexible sheet-like member, and a surface thereof in the neighborhood of an end thereof is extended from a cover 112 so as to contact an outer surface of the fixing belt 105 (so-called surface contact). Further, the extension direction of the sheet-like member 120 from the cover 112 is inclined, with respect to a radial direction of the fixing belt 105 (direction perpendicular to a rotational axis direction of the fixing belt 105), toward a downstream side (toward the nip entrance 101*c*) with respect to a rotational direction (R105) of the fixing belt 105. That is, the sheet-like member 120 is provided in contact with the fixing belt 105 so that the extension direction, toward an edge of the sheet-like member 120, of an end region 120X (FIG. 11) of the sheet-like member 120 is substantially directed toward the downstream side of the rotational direction of the fixing belt 105. The sheet-like member 120 has a constitution in which the sheet-like member 120 is abutted against the fixing belt 105 so that the extension direction thereof is the same as the rotational direction of the fixing belt 105. By employing such a constitution, there is an increase in sliding resistance of the sheet-like member 120 with the fixing belt 105.

Further, the sheet-like member 120 is formed of a fluorine-containing resin material having a heat-resistance property, a sliding property and elasticity in combination, and is constituted so as to block dust between the casing 100 and the fixing belt 105 by being urged against the fixing belt 105 by an elastic force thereof. That is, the sheet-like member 120 functions as a sealing member (shielding member) for sealing (confining) the dust in the neighborhood of the sheet introducing opening 400.

Figure 10:
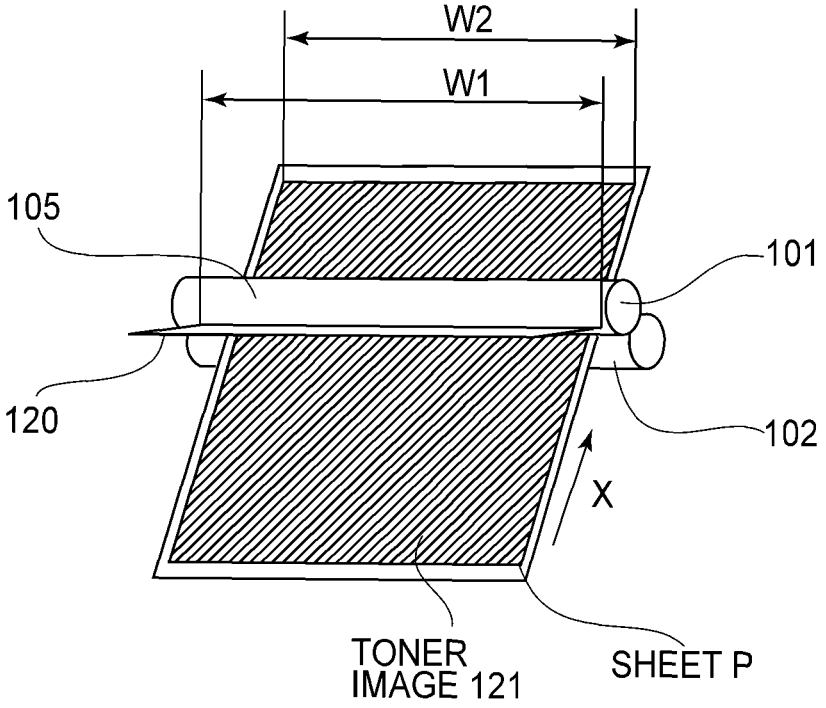
FIG. 10 is a schematic view showing positional relationship between a toner image passing region and a diffusion suppressing member.

Further, a longitudinal width W1 of the sheet-like member 120 may preferably be, as shown in a perspective view of a principal part of the fixing apparatus (in which members such as the cover 112 constituting the casing 100 are omitted from illustration) in FIG. 10, set so as to be wider than a width W2 of a passing region of a toner image 121 on the sheet P.

Incidentally, the width W2 corresponds to a width (maximum image width) of a region in which when a maximum width sheet usable in the image forming apparatus, the image is formable on the maximum width sheet. As a result, the sheet-like member 120 establishes a positional relationship with the fixing belt 105 in which the fixing belt 105 is extended outside of widthwise ends of a region in which the fixing belt 105 is contactable to the toner image 121.

Further, with respect to a disposition position of the sheet-like member 120, the sheet-like member 120 may preferably be, as described above, provided in the neighborhood of the dust generating region, i.e., in the neighborhood of the introducing opening 400 (nip entrance 101*c*) of the casing 100. This is because with a distance closer to the dust generating region, the dust density is higher and thus the above-described coalescence effect is enhanced further.

The data on the right side of a bar graph of FIG. 7 shows a dust density measured at the point B (FIG. 6) in the case where the above-described sheet-like member 120 is provided. Compared with the case where there is no sheet-like member 120 (the central data in the bar graph of FIG. 7), the dust density at the point B was able to be suppressed to about ⅕.

Further, in this embodiment, the diffusion suppressing member 120 has a shape such that the diffusion suppressing member 120 extends from the cover 112 of the casing 100 toward the fixing belt 105, but such a shape may also be not necessarily employed. For example, a constitution in which a portion (member) of the cover 112 closest to the introducing opening 400 is caused to also function as the diffusion suppressing member may be employed. However, in order that the fixing belt 105 is not readily deteriorated by the sliding, it is further preferable that a constitution in which the flexible sheet-like member 120 as described above is fixed on the casing 100, formed of a resin material, by a method such as adhesive bonding or the like is employed.

Next, a fixing apparatus 103 in Embodiment 2 will be described with reference to FIG. 11. A difference from the fixing apparatus 103 in Embodiment 1 is that in addition to the sheet-like member 120 as the diffusion suppressing member in the fixing belt 105 side, a sheet-like member 130 as the diffusion suppressing member (contact member) is also provided in the pressing roller 102 side. Other constituent elements are the same as those in Embodiment 1, and therefore will be omitted from a detailed description by adding thereto the same reference numerals or symbols.

The sheet-like member 120 in the fixing belt 105 side will be omitted from description, and in the following, the sheet-like member 130 in the pressing roller 102 side will be described specifically.

Figure 11:
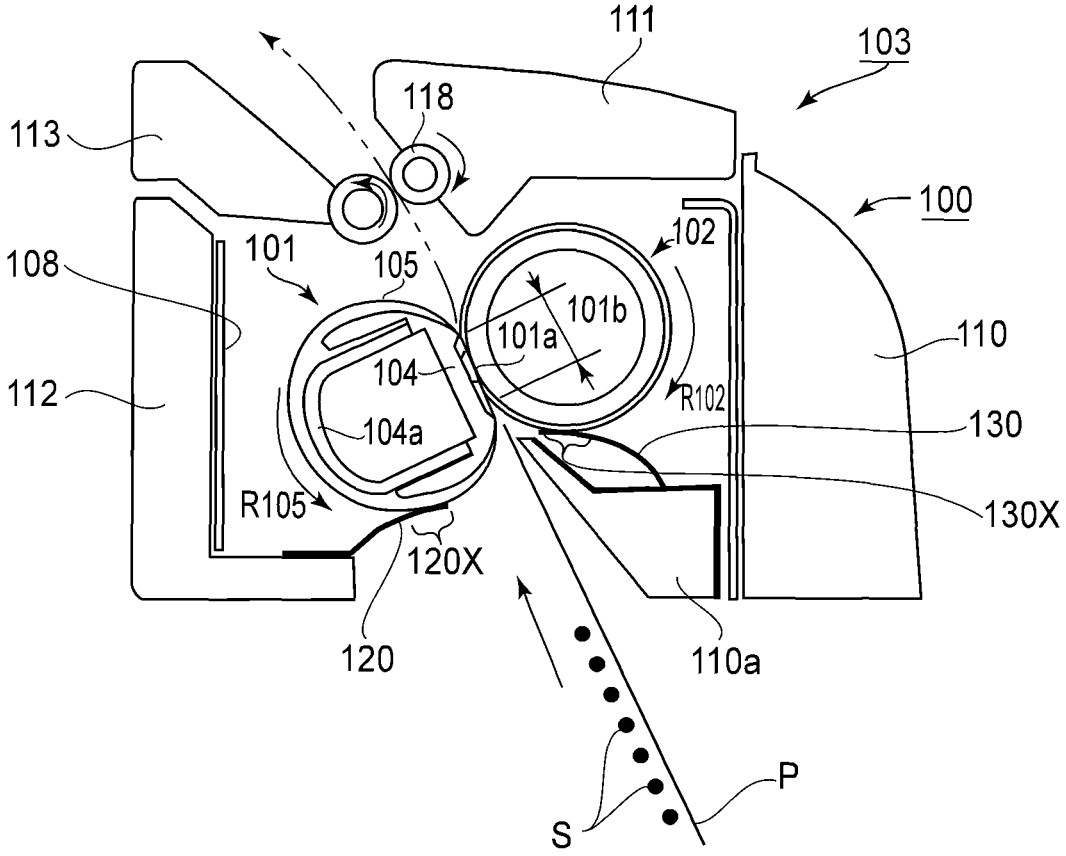
FIGS. 11 and 12 are schematic sectional views of a fixing apparatus.

As shown in FIG. 11, the diffusion suppressing mechanism includes a diffusion suppressing member 130, functioning as a suppressing portion, in the neighborhood of the introducing opening (sheet introducing opening) 400 of the casing 100. Thus, in this embodiment, also the airflow path 25 shown in Figure (b) is blocked (cut off).

Specifically, the diffusion suppressing member 130 is a flexible sheet-like member, and a surface thereof in the neighborhood of an end thereof extends from a back surface of a guide portion 110*a* (as a part of the cover 110) for guiding the sheet P toward the nip 101*b* so as to contact an outer surface of the pressing roller 102 (so-called surface contact). Further, the extension direction of the sheet-like member 130 from the back surface of the guide portion 110*a* is inclined, with respect to a radial direction of the pressing roller 102 (direction perpendicular to a rotational axis direction of the pressing roller 102), toward a downstream side (toward the nip entrance 101*c*) with respect to a rotational direction (R102) of the pressing roller 102. That is, the sheet-like member 130 is provided in contact with the pressing roller 102 so that the extension direction, toward an edge of the sheet-like member 130, of an end region 130X (FIG. 11) of the sheet-like member 130 is substantially directed toward the downstream side of the rotational direction of the pressing roller 102. The sheet-like member 130 has a constitution in which the sheet-like member 130 is abutted against the pressing roller 102 so that the extension direction thereof is the same as the rotational direction of the pressing roller 102. By employing such a constitution, there is an increase in sliding resistance of the sheet-like member 130 with the pressing roller 102.

Further, the sheet-like member 130 is formed of a fluorine-containing resin material having a heat-resistance property, a sliding property and elasticity in combination, and is constituted so as to block between the casing 100 and the pressing roller 102 by being urged against the pressing roller 102 by an elastic force thereof. That is, the sheet-like member 120 functions as a sealing member (shielding member) for sealing (confining) the dust in the neighborhood of the sheet introducing opening 400.

Further, a longitudinal width W1 of the sheet-like member 130 may preferably be, similarly as the sheet-like member 120 described in Embodiment 1 with reference to FIG. 10, set so as to be wider than a width W2 of a passing region of a toner image 121 on the sheet P. Further, the sheet-like member 130 may also establish a positional relationship with the pressing roller 102 in which the pressing roller 102 extends outside of widthwise ends of a region in which the pressing roller 102 is contactable to a maximum width sheet.

Further, with respect to a disposition position of the sheet-like member 130, the sheet-like member 130 may preferably be, similarly as the sheet-like member 120 described in Embodiment 1, provided in the neighborhood of the dust generating region, i.e., in the neighborhood of the introducing opening 400 (nip entrance 101*c*) of the casing 100. This is because with a distance closer to the dust generating region, the dust density is higher, and thus the above-described coalescence effect is enhanced more.

As described above, by providing the sheet-like member 120 together with the sheet-like member 120, the dust density can be further suppressed.

Incidentally, in this embodiment, the diffusion suppressing member 130 has a shape such that the diffusion suppressing member 130 extends from the casing 100 toward the pressing roller 102, but such a shape may also be not necessarily employed. For example, a constitution in which a portion (member) of the guide portion 110*a* closest to the introducing opening 400 is caused to also function as the diffusion suppressing member may be employed. However, in order that the pressing roller 102 is not readily deteriorated by the sliding, it is further preferable that a constitution in which the flexible sheet-like member 120 as described above is fixed on the casing 100, formed of a resin material, by a method such as adhesive bonding or the like is employed.

Figure 12:
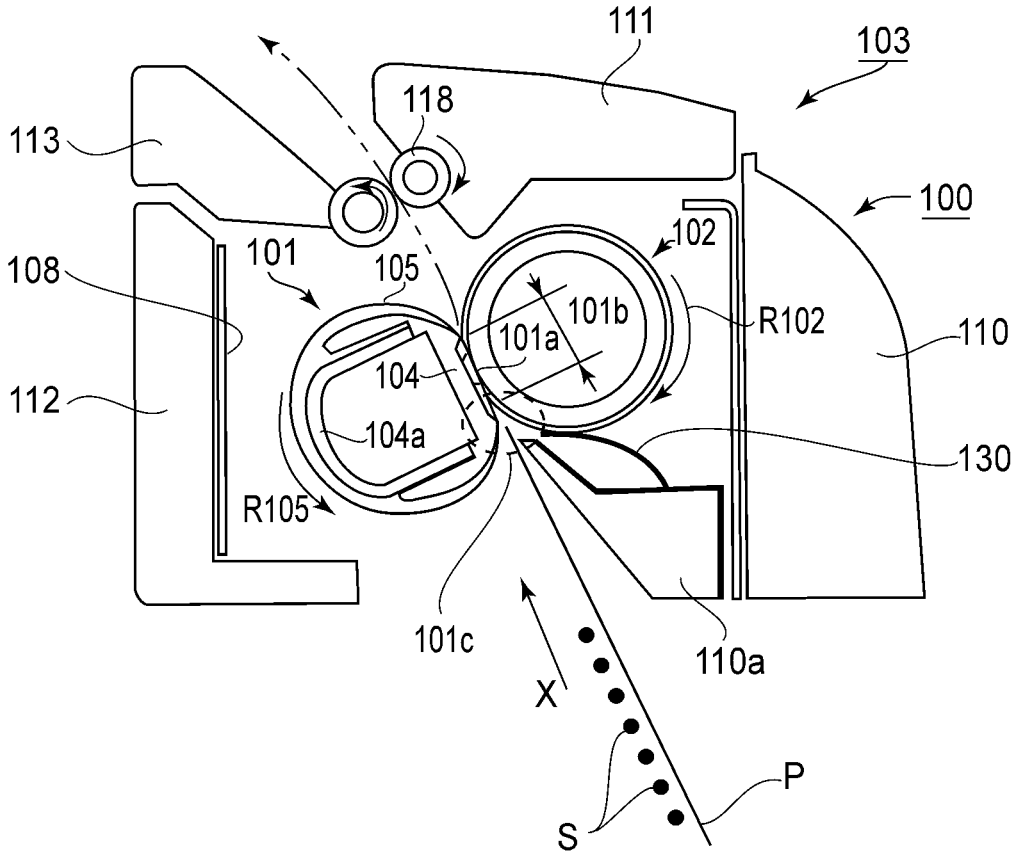

Incidentally, in this embodiment, the sheet-like member 130 is provided together with the sheet-like member 120, but the following constitution may also be employed. Specifically, as shown in FIG. 12, such a constitution that the sheet-like member 120 in the fixing belt 105 side is not provided but the sheet-like member 130 is provided in the pressing roller 102 side similarly as in this embodiment (Embodiment 2).

Also when such a constitution is employed, similarly as in Embodiment 1, it is possible to suppress the dust density.

Embodiment 3

Figure 13:
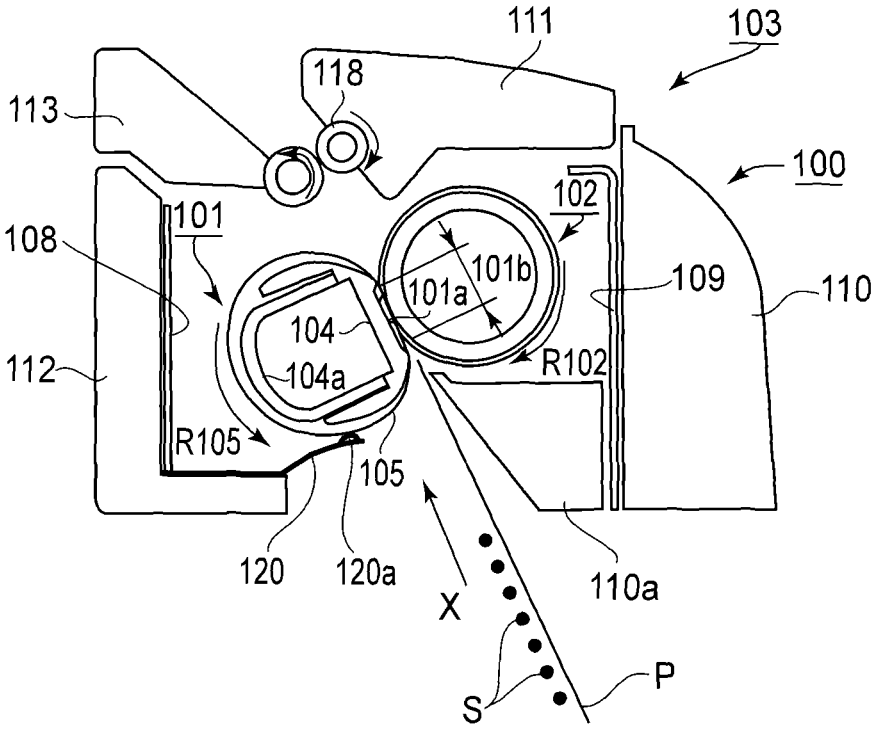
FIG. 13(*a*) is a schematic sectional view of a fixing apparatus, and FIG. 13(*b*) is a partly enlarged view of a diffusing suppressing member.
Figure 13:
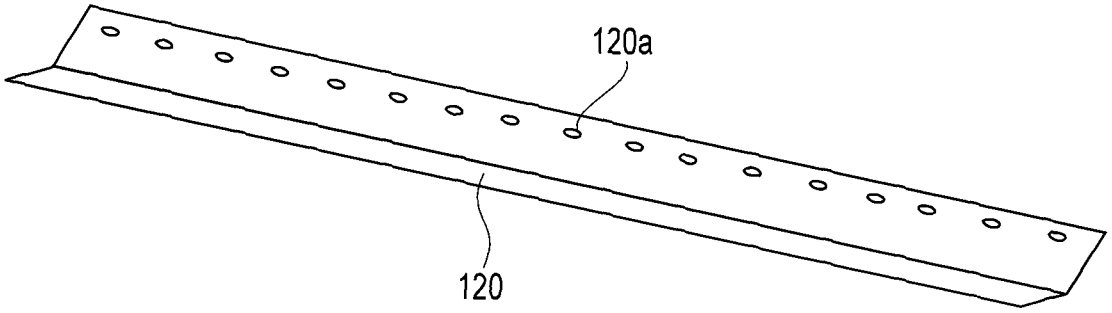

Next, a fixing apparatus 103 in Embodiment 3 will be described with reference to FIG. 13. A difference from the fixing apparatus 103 in Embodiment 1 is that the sheet-like member 120 is provided discretely with a plurality of projections 120*a* with respect to a longitudinal direction of the sheet-like member 129. Other constituent elements are the same as those in Embodiment 1, and therefore will be omitted from a detailed description by adding thereto the same reference numerals or symbols.

The above-described offset phenomenon on the fixing belt 105 cannot be completely prevented even when the parting agent (wax) is contained in the toner S, and further, there is a fear that paper powder or the like of the sheet is deposited on the fixing belt 105. That is, there is a fear that some contamination substance is deposited on the fixing belt 105. In that case, the deposition leads to deposition of the contamination substance at a contact portion between the sheet-like member 120 and the fixing belt 105 in Embodiment 1. Further, in the case where the contamination substance remains in a certain amount or more and is then peeled off from the contact portion, there is a fear that the contamination substance is transferred onto the sheet P.

Therefore, in this embodiment, the projections 120*a* are provided, so that in a region where the sheet-like member 120 opposes the fixing belt 105, a spacing of about 0.2 mm to the extent that a dust sealing (confining) effect is not impaired is ensured. Accordingly, the airflow RD1 (FIGS. 9(*a*) and 9(*b*)) enters the spacing to prevent the dust from entering the spacing, and therefore the dust sealing effect is not impaired.

As a result, most of such a contamination substance passes through the spacing, so that it becomes possible to suppress the transfer of contamination substance onto the sheet P. Incidentally, a part of the contamination substance is deposited in the neighborhood of the projections 120*a*, but the deposited amount is very small, thus being at a practically negligible level.

Figure 14:
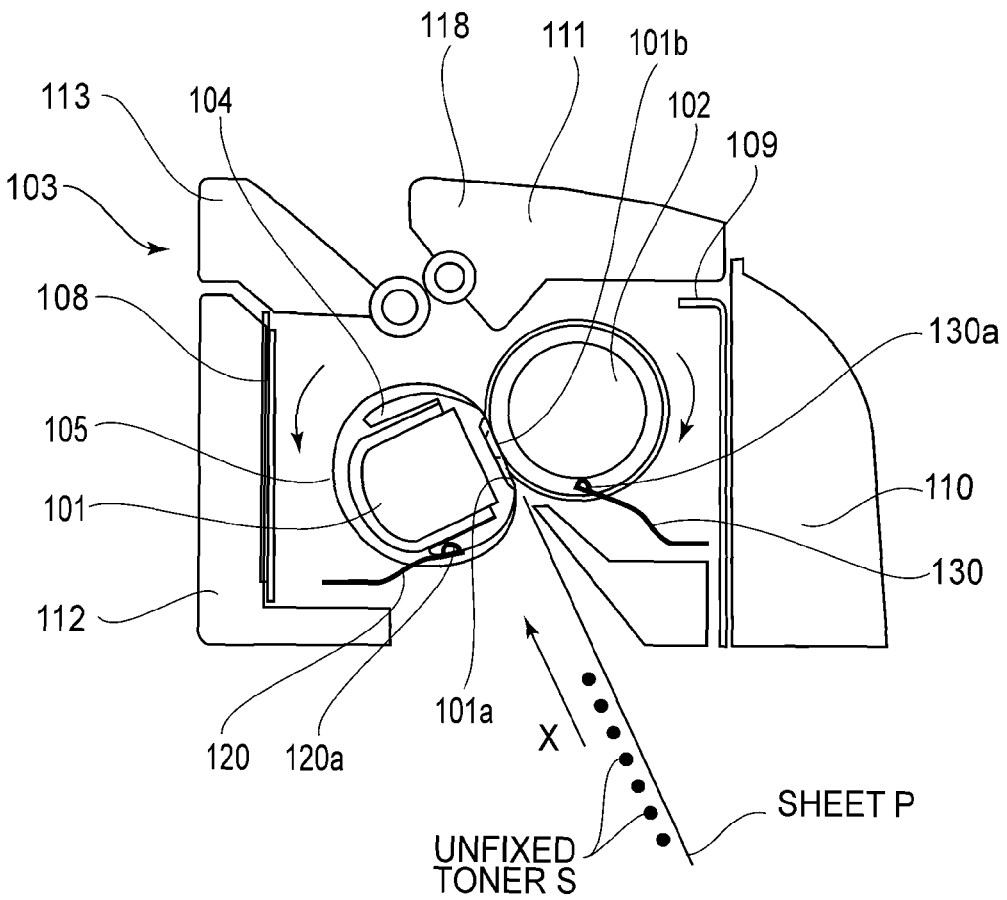
FIG. 14(*a*) is a schematic sectional view of another fixing apparatus, and FIG. 14(*b*) is a partly enlarged view of another diffusions suppressing member.
Figure 14:
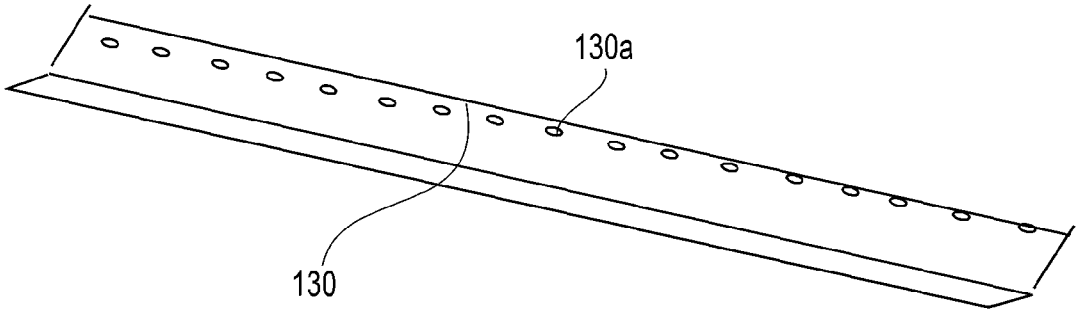

Incidentally, as shown in FIG. 14, a constitution in which the sheet-like member 130 is provided in the pressing roller 102 side and is, similarly as the sheet-like member 120, provided discretely with a plurality of projections 130*a* with respect to the longitudinal direction of the sheet-like member 130 may also be employed. As a result, it becomes possible to solve the problem resulting from the contamination substance while realizing a further lowering in dust density.

Embodiment 4

Figure 15:
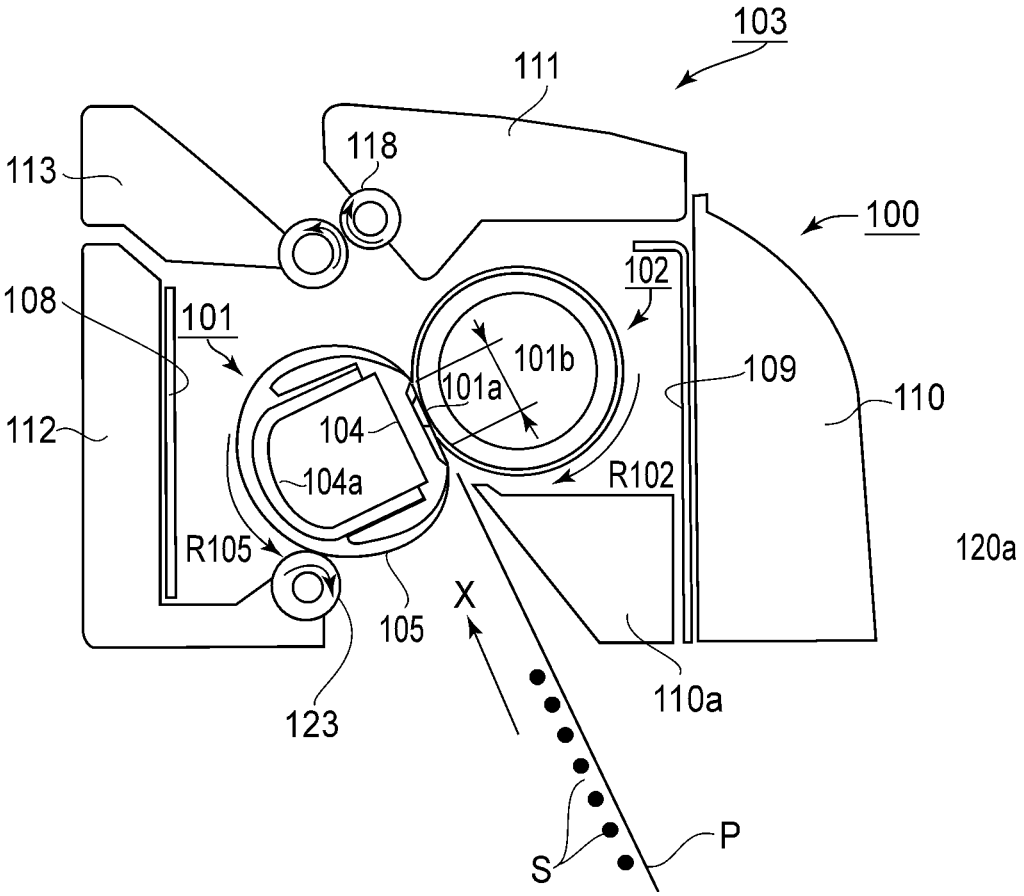
FIG. 15 is a schematic sectional view of a fixing apparatus.

Next, a fixing apparatus 103 in Embodiment 4 will be described with reference to FIG. 15. A difference from the fixing apparatus 103 in Embodiment 1 is that a rotatable member 123 mounted on a cover 112 is used as the diffusion suppressing member (contact member). Other constituent elements are the same as those in Embodiment 1, and therefore will be omitted from detailed description by adding thereto the same reference numerals or symbols.

In this embodiment, the rotatable member 123 functioning as the diffusion suppressing member is rotatably mounted on the cover 112. Further, the rotatable member 123 is mounted in contact with outer peripheral surface of the fixing belt at an outer peripheral surface thereof with no spacing.

The rotatable member 123 is constituted so that the rotatable member 123 is rotated by rotation of the fixing belt 105 when the fixing belt 105 is rotated. Further, the rotatable member 123 is a region, formed of a heat-resistant silicone rubber, coated with a PFA tube.

In this way, in this embodiment, sliding friction between the rotatable member 123 and the fixing belt 105 is reduced to the possible extent, and therefore the fixing belt 105 is not damaged, and it becomes also possible to suppress deposition of the contamination substance at a contact portion between the rotatable member 123 and the fixing belt 105.

Figure 16:
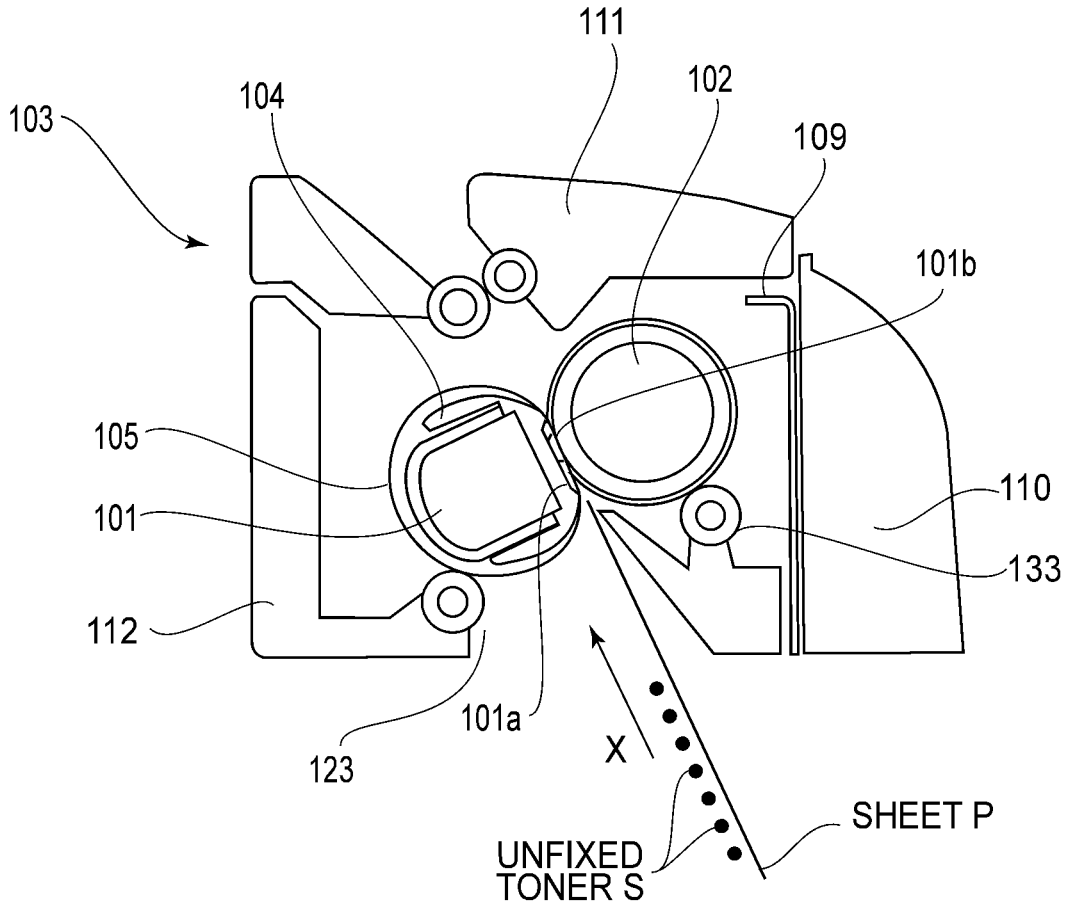
FIG. 16 is a schematic sectional view of another fixing apparatus.

Incidentally, as shown in FIG. 16, a constitution in which the rotatable member 123 is provided in the fixing belt 105 side and in addition, a rotatable member 133 similar to the rotatable member 123 is provided in the pressing roller 102 side may also be employed. As a result, it becomes possible to suppress deterioration of the fixing belt and the pressing roller while realizing a further lowering in dust density.

In the above, as the fixing apparatus to which the present invention is applicable, those in Embodiments 1 to 4 are described as examples, but the following constitutions may also be employed.

As the diffusion suppressing member, members are not limited to those in the above-described embodiments of the members can seal between the casing 100 of the fixing apparatus and the fixing belt 105 (pressing roller 102) to prevent movement of the dust, and may also has a constitution using, e.g., heat-resistant sponge if the members perform functions thereof.

Further, the fixing belt is not constituted so as to be rotationally driven by the pressing roller, but for example, a constitution in which the fixing belt is extended and stretched by a plurality of supporting rollers and is rotationally driven by one of these supporting rollers may also be employed. Further, a constitution in which a fixing roller is used in place of the fixing belt may also be employed, Further, as the heating source for heating the fixing belt, the member is not limited to the above-described plant heater 101*a* heating source, such as an exciting coil for effecting electromagnetic induction heating, a halogen heater or an infrared lamp may also be employed. In this case, an urging pad for urging the fixing belt from an inside of the fixing belt toward the pressing roller is to be used. Further, a constitution in which the heating source is disposed outside the fixing belt may also be employed.

Further, a constitution in which in place of the pressing roller, a pressing belt is used may also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 209397/2012 filed Sep. 24, 2012 and 162435/2013 filed Aug. 5, 2013, which are hereby incorporated by reference.

What is claimed is:

1. A fixing apparatus comprising:

first and second rotatable members configured to heat-fix, at a nip therebetween, a toner image of toner containing a parting agent formed on a sheet;

a casing, configured to accommodate said first and second rotatable members, including a sheet introducing opening and a sheet discharging opening; and a sheet-like member provided on said casing and configured to suppress diffusion, toward the sheet discharging opening, of particles having a predetermined diameter resulting from the parting agent in a sheet-introducing-opening side of the apparatus, wherein said sheet-like member is in contact with said first rotatable member in the sheet-introducing-opening side of the apparatus so as to block the diffusion between said casing and said first rotatable member.

2. A fixing apparatus according to claim 1, wherein said sheet-like member extends to each of outsides, with respect to a widthwise direction, of a region where an image formable region of a maximum width sheet usable in said fixing apparatus passes.

3. A fixing apparatus according to claim 1, wherein an extension direction of a free end region of the sheet-like member is directed toward a downstream side of said first rotatable member with respect to a rotational direction of said first rotatable member, wherein a portion of said sheet-like member, closer to a base portion of said sheet-like member than a free end of said sheet-like member, contacts said first rotatable member.

4. A fixing apparatus according to claim 3, wherein said first sheet-like member is discretely provided with a plurality of projected portions in a region where said sheet-like member opposes said first rotatable member.

5. A fixing apparatus according to claim 1, wherein the parting agent is a wax and the predetermined particle size is 5.6 nm or more and 560 nm or less.

6. A fixing apparatus according to claim 1, wherein said first rotatable member is provided so as to be contactable to an unfixed toner image forming surface of the sheet.

7. A fixing apparatus according to claim 1, wherein said first rotatable member is provided so as to be contactable to an opposite surface of the sheet, from an unfixed toner image forming surface of the sheet.

8. A fixing apparatus according to claim 1, wherein said first and second rotatable members are provided so that the sheet introducing opening is located below the sheet discharge opening with respect to a direction of gravitation.

9. A fixing apparatus according to claim 1, wherein said sheet-like member is made of a fluorine resin material.

10. A fixing apparatus comprising:

first and second rotatable members configured to heat-fix, at a nip therebetween, a toner image of toner containing a parting agent formed on a sheet;

a casing, configured to accommodate said first and second rotatable members, including a sheet introducing opening and a sheet discharging opening; and a first sheet-like member provided on said casing and configured to suppress diffusion, toward the sheet discharging opening, of particles having a predetermined diameter resulting from the parting agent in a sheet-introducing-opening side of the apparatus, wherein said first sheet-like member is in contact with said first rotatable member in the sheet-introducing-opening side of the apparatus so as to block the diffusion between said casing and said first rotatable member; and a second sheet-like member provided on said casing and configured to suppress diffusion, toward the sheet discharging opening, of particles having a predetermined diameter resulting from the parting agent in the sheet-introducing-opening side of the apparatus, wherein said second sheet-like member is in contact with the second rotatable member in the sheet-introducing-opening side of the apparatus so as to block the diffusion between said casing and said second rotatable member.

11. A fixing apparatus according to claim 10, wherein each of said first and second sheet-like members extends to each of outsides, with respect to a widthwise direction, of a region where an image formable region of a maximum width sheet usable in said fixing apparatus passes.

12. A fixing apparatus according to claim 10, wherein an extension direction of a free end region of the first sheet-like member is directed toward a downstream side of said first rotatable member with respect to a rotational direction of said first rotatable member, wherein a portion of said first sheet-like member, closer to a base portion of said first sheet-like member than a free end of said first sheet-like member contacts said first rotatable member, wherein an extension direction of a free end region of the second sheet-like member is directed toward a downstream side of said first rotatable member with respect to a rotational direction of said second rotatable member, and wherein a portion of said second sheet-like member, closer to a base portion of said second sheet-like member than a free end of said second sheet-like member contacts said second rotatable member.

13. A fixing apparatus according to claim 12, wherein said first sheet-like member is discretely provided with a plurality of projected portions in a region where said first sheet-like member opposes said first rotatable member, and wherein said second sheet-like member is discretely provided with a plurality of projected portions in a region where said second sheet-like member opposes said second rotatable member.

14. A fixing apparatus according to claim 10, wherein the parting agent is a wax and the predetermined particle size is 5.6 nm or more and 560 nm or less.

15. A fixing apparatus according to claim 10, wherein said first and second rotatable members are provided so that the sheet introducing opening is located below the sheet discharge opening with respect to a direction of gravitation.

16. A fixing apparatus according to claim 10, wherein each of said first sheet-like member and said second sheet-like member is made of a fluorine resin material.

17. A fixing apparatus comprising:

first and second rotatable members configured to heat-fix, at a nip therebetween, a toner image of toner containing a parting agent formed on a sheet;

a casing, configured to accommodate said first and second rotatable members, including a sheet introducing opening and a sheet discharging opening; and a sheet-like member provided on said casing in a sheet-introducing-opening side of the apparatus, wherein said sheet-like member contacts said first rotatable member so as to block diffusion of particles between said casing and said first rotatable member.

18. A fixing apparatus according to claim 17, wherein said sheet-like member is extended to each of outsides, with respect to a widthwise direction, of a region where an image formable region of a maximum width sheet usable in said fixing apparatus passes.

19. A fixing apparatus according to claim 17, wherein an extension direction of a free end region of said sheet-like member is directed toward a downstream side of said first rotatable member with respect to a rotational direction of said first rotatable member, and wherein a portion of said sheet-like member, closer to a base portion of said sheet-like member than a free end of said sheet-like member contacts said first rotatable member.

20. A fixing apparatus according to claim 17, wherein said sheet-like member is made of a fluorine resin material.

* * * * *